US008920135B2

(12) United States Patent
Daily

(10) Patent No.: US 8,920,135 B2
(45) Date of Patent: Dec. 30, 2014

(54) MULTIPURPOSE GRAVITY AIR COMPRESSOR

(71) Applicant: Dennis Eugene Daily, Duncan, MS (US)

(72) Inventor: Dennis Eugene Daily, Duncan, MS (US)

( * ) Notice: Subject to any disclaimer, the term of this patent is extended or adjusted under 35 U.S.C. 154(b) by 35 days.

(21) Appl. No.: 13/798,672

(22) Filed: Mar. 13, 2013

(65) Prior Publication Data

US 2014/0271240 A1 Sep. 18, 2014

(51) Int. Cl.
*F04B 31/00* (2006.01)
*F04B 39/10* (2006.01)

(52) U.S. Cl.
CPC ..... *F04B 39/10* (2013.01); *F04B 31/00* (2013.01)
USPC ..... 417/328; 417/320; 60/495

(58) Field of Classification Search
CPC ..... F04B 19/003; F04B 31/00
USPC ..... 417/56, 61, 320, 328, 330; 60/398, 495
See application file for complete search history.

(56) References Cited

U.S. PATENT DOCUMENTS 2,478,051 A * 8/1949 Nordell ..... 417/320
2010/0031651 A1* 2/2010 Spataro ..... 60/495

* cited by examiner

*Primary Examiner* — Charles Freay
*Assistant Examiner* — Philip Stimpert

(57) ABSTRACT

A multipurpose gravity air compressor employs a piston (40) traveling down a cylinder (129) by the force of gravity compressing compressible fluid (140) in one or more compressible fluid chambers (137). Compressed fluid is emptied out of compressible fluid chambers (137) through compressible fluid exit (118) for use locally or downstream. A transporter such as transporter assembly 50 grabs piston (40) and recovers it back to opening (124) at predetermined intervals and deposits piston (40) into cylinder (129) to start another cycle. Multipurpose gravity air compressor through the generation of heat through compressing compressible fluid (140) also enjoys being a heat source. Air compressor 200 can provide a means for producing energy through compressing compressible fluid (140) and a source of heat for generating steam to produce electricity on-site or downstream. Water (condensation), possibly thousands of gallons a year, could be another rainfall-independent water source advantage enjoyed.

8 Claims, 23 Drawing Sheets

Fig. 6c
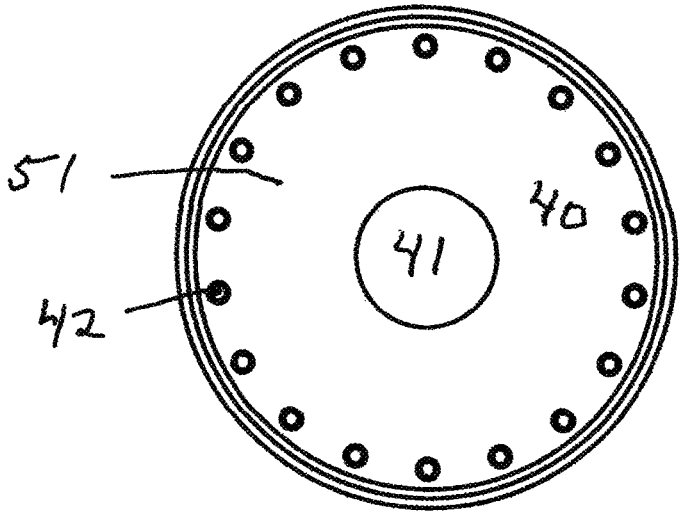
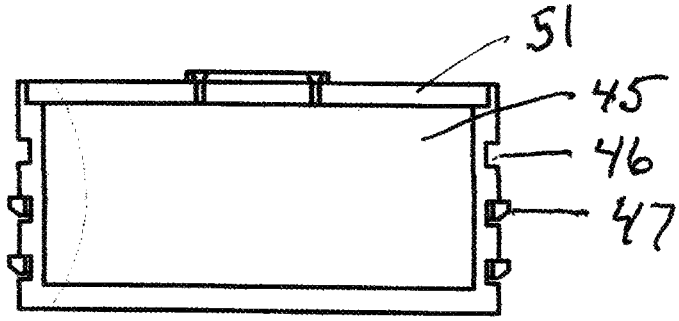
Fig. 6d
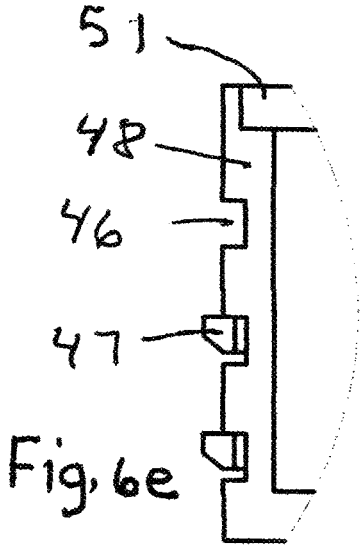
Fig. 6e 50
56
54
58
74
75
55
57
53
62
60
52
59

MULTIPURPOSE GRAVITY AIR COMPRESSOR

BACKGROUND

This application relates to an air compressor with recovery, more specifically to a gravity air compressor, and even more specifically to the new multi-purpose, air compressor. Studies show when using compressed air to make electricity, just as much or more electricity is needed to make the compressed air as the amount of electricity that can be made with the compressed air. While many types of technology exist for the production of alternative green energy, there remains, a need for a system, method and apparatus for providing increased efficiency in the production of on-site power, removing the need for transporting energy long distances to the site. Historically wind machines and solar power has been unreliable.

The sun goes down and the wind stops blowing. Nuclear energy has its well documented drawbacks, such as natural disasters and waste. The use of carbon based fuels could be costly, dirty, and possibly a threat to our national economy and security. Heat has been a disadvantage with prior air compressors. With the present apparatus, green energy can be produced reliably from compressed air environmentally, economically, consistently, and on-site. Water (condensation), possibly thousands of gallons a year, could be another rainfall-independent water source advantage enjoyed.

SUMMARY OF THE INVENTION

The present invention provides for an air compressor apparatus for compressing a compressible fluid, comprising a piston, an opening located in a predetermined location configured for at least one of a compressible fluid entrance for the first compressible fluid, and a piston entrance, larger in diameter than a diameter of the piston for the piston. The present invention further provides for an exit located in a predetermined location below the opening configured for at least one of a compressible fluid exit configured for the exit of the first compressible fluid, and a piston exit configured for the exit of the piston. The present invention further provides for a cylinder with a slope of between approximately 30 degrees and 160 degrees and with a central elongated hollow part configured to house the pistons disposed in predetermined timed, intervals defining a plurality of compression chambers each having a top and a bottom piston and travels cyclically from top to bottom inside the central elongated hollow part of the cylinder. Each of the pistons are configured to form a substantially fluid tight seal between the piston and a cylinder wall and each of the pistons are configured to urge down the cylinder wall, with little friction by the force of gravity compressing the first compressible fluid. The present invention further provides for a transporter configured to transport pistons from said piston exit to said piston entrance and at least one of, allow appropriate predetermined time to refill a filling region of the cylinder with the first compressible fluid, introduces and disposes the piston into the cylinder at predetermined intervals, trapping the low pressure first compressible fluid in the filling region of the cylinder. The piston then urges down the hollow part of the cylinder forced by gravity, to compress the first compressible fluid in one or more of the compression chambers before another piston is introduced into the upper filling region of the cylinder. The air compressor apparatus can be configured to have a compressor and the transporter as separate working member elements. In a preferred aspect of the present invention, the air compressor further comprises tubing with adequate strength that is wrapped around and about the outside of the cylinder, further comprising connectors configured to attach the tubing to the cylinder. The tubing also has an entrance for a second fluid and an exit to exit the second fluid.

U.S. Pat. No. 2,478,051 to Nordell Carl H. patented August/1949 a Hydraulic air compressor discloses pouring water down the cylinder for the purpose of a seal between the piston and the cylinder wall. The prior art has a built in limitation, if the temperature changes significantly and the water freezes or turns to gas the seal becomes dysfunctional. Unlike most air compressors heat in the present invention is enjoyed. The present invention can be used in rural areas as it does not require power lines or fossil fuels. The present invention does not need a steady source of water and produces its own heat so it could be used in cold climates without ice buildups. One cost efficient advantage of the present invention is that the parts are off the shelf parts and are readily available.

BRIEF DESCRIPTION OF THE DRAWINGS

FIG. 6*c* shows an overhead view of a piston lid.

FIG. 6*d* shows a sectional view of a side of a piston.

FIG. 6*e* shows a cutaway view of a piston side.

DEFINITIONS

Figure 1A:
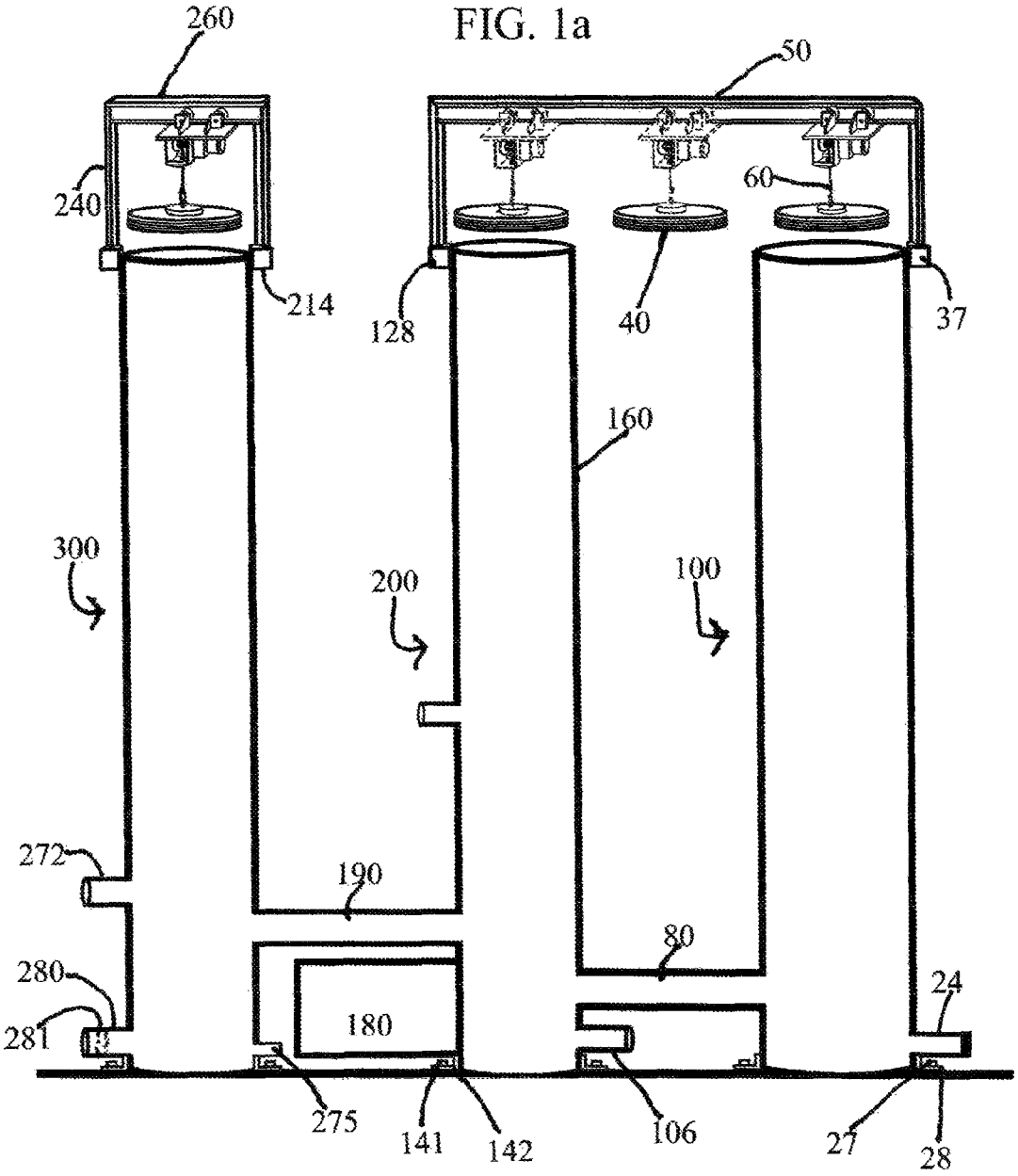
FIG. 1*a* shows a front view of a system for compressing air.

1. Cylinder—A cylinder is a working member of an air compressor. A cylinder must be made of materials capable of withstanding the substantial heat and pressures built up in the cylinder while compressing air or compressible fluid safely. A cylinder is capable of fluid isolation between the cylinder walls and the pistons. A cylinder may also be defined as the space that the piston travels. Multiple working pistons can be in a single cylinder forming compression chambers, plenum chambers, gas compression chambers, fluid compression chambers. A cylinder is often made of metallic, carbon steel, fiber, concrete, or plastic materials. A cylinder can also be defined and used for holding or storing fluids such as liquids or gases. Herein a cylinder could be covered, having a closed bottom, floating piston, or topless. It could have a bottom, top, or disposed piston stops, (to stop a piston from passing out the bottom or top). A piston can be positioned, lowered, deposited and disposed into the cylinder through the top opening or an opening in the side of the cylinder. Cylinder herein could be defined as a tank, tube, elongated hollow body, hollow body, hollow part, hollow central area, pipe, and could be used interchangeably and have the same function. A cylinder can have slick inner walls with slideability and little friction. A cylinder can be ridged or flexible. A cylinder can twist and turn as long as the pistons can move freely without resistance. A cylinder may be sleeved or sleeveless. A cylinder can have one or more casings for a purpose such as insulation or enhancing heat. The casing could be solid or hollow used as a vessel. A cylinder can have a lining, inner lining or outer lining. A cylinder may have insulation on its outside walls or anywhere enjoyed. A cylinder can have hollow areas for transporting or holding fluids for heating, cooling or containing a liquid while making steam or supercritical water. A cylinder can have tubing capable of holding a fluid or steam, wrapped outside, inside flush to the cylinder walls or in the center of the cylinder walls to take advantage of heat generated while compressing air or other compressible fluids. In a particular context fluid can be used herein as a liquid such as water. In another particular context fluid can be used herein as a gas such as air. Compressible fluid and fluid herein is defined as any fluid that can be compressed such as air and can be compressed in a safe manner by someone skilled in the art using the embodiments and elements discussed herein. Water is a fluid used herein as a liquid with a density greater than a piston. Gas, fluid, air herein refers to any gas that can be compressed in a safe manner by someone skilled in the art using the embodiments and elements discussed herein.

2. Piston—A piston is a working member of an air compressor, or compressor. A piston is the moving component that could be contained within the cylinder and is made fluid-tight by piston rings. The definition of a piston herein is unique with other compressors in that it has no connecting rigid rod. A piston can be pushed through an outlet or a piston transfer duct into a liquid where the piston is buoyant and floats upwards to the liquids surface where it is transferred back to the top of the air compressor to complete its cycle. The piston definition is unique with other compressors in that it has a cavity, capable of fluid isolation, used as a receptacle or container. A container can be used to put or keep matter in for adjusting the weight of the piston or using the heat generated from compressing compressible fluid inside the cylinder to cook the contents in the cavity of the piston. The piston once finding equilibrium with the fluid in the cylinder may be released and free floating. The piston can fall free or be deposited into a cylinder. One or more working member pistons inside the cylinder form one or more compression chambers, plenum chambers, fluid compression chambers, or air compression chambers, which can be mixed and matched to the extent possible with different contents. A piston is also defined as a working member that has relative sliding sealing engagement with the encompassing wall of a cylinder. Each piston is capable of fluid isolation from each other. Herein it is contemplated that any separating platform that prevents mixing of the media (fluid) between the atmospheric air and the compressible fluid in the fluid compression chamber could be used as a container, floating container, piston, disk, or floating piston and could be configured to have the same functionality and these terms may be used interchangeably.

3. Base state—is defined herein as a state in which all valves and outlets are closed.

4. Compressible fluid—Any fluid that can be compressed safely and without doing damage to the system, embodiments or elements, such as corrosion.

5. Fluid compression chamber—A fluid compression chamber is defined herein as a chamber having slideability and capable of fluid isolation containing contained compressible fluid safely such as air at positive pressure. A fluid compression chamber can be a working member of a multi-purpose gravity air compressor having a top and bottom piston filled with plenum, gas or air in between the two pistons contained in a cylinder. A fluid compression chamber can be a cylinder with a bottom at base state with one piston and positive pressured compressible fluid or air in between. Compression chamber, compressible fluid chamber, air compression chamber or compressed air chamber all could have the same functionality and could be used interchangeably. One piston with sufficient weight above another piston with sufficient weight inside a cylinder configured to be capable of fluid isolation and containing compressible fluid in between comprises a compressible fluid chamber. Compressible fluid chambers are defined and formed when a piston with sufficient weight is deposited or dropped down a cylinder at sufficient timed intervals configured to form one or more positive pressure chambers capable of fluid isolation from each other. Compressible fluid chambers in a cylinder are found in a plurality preferably. Weighted compressible fluid chambers could be one or more and configured to be sufficiently vertical and are forced or urged down a cylinder substantially friction free with slideability by the force of gravity.

6. Primed—made ready for use or service. The transfer tank 100 is defined herein as being primed when it is full of liquid such as water and contains a predetermined number of buoyant pistons from the bottom to the top at predetermined staggered intervals and is at base state. The air compressor and the cylinder are defined herein as being primed when at base state a piston capable of fluid isolation has been placed and positioned inside the top of a vertical cylinder and is urged down by the force of gravity until it finds equilibrium. The piston is then released with the air or compressible fluid inside the cylinder located below the piston and sets there free to move up or down the cylinder walls with substantially little friction forming a compressible fluid chamber. Ambient air through the top of the cylinder refills the cylinder as the piston moves downward, this continues with each piston placed into the top of the cylinder respectively. Then another piston capable of fluid isolation from each other is placed and positioned inside the top of a vertical cylinder and is urged down by the force of gravity until it finds equilibrium. Then it is released with the compressible fluid inside the cylinder located below the second piston and above the first piston and sets there free to move up or down the cylinder walls with substantially little friction forming a second compressible fluid chamber. This continues respectively until a predetermined number of piston has been lowered into the cylinder forming a predetermined number of compressible fluid chambers. When this is completed the air compressor is considered to be primed. The air receiver tank is considered primed when at base state the floating piston capable of fluid isolation is allowed to be lowered down the inside cylinder walls until it finds equilibrium and compressed air from the air compressor is allowed to flow through the air flow duct and into the air receiver tank. Compressed air and the weight of the floating piston must have been predetermined and configured to allow the floating piston to rise and fall while maintaining the psi desired in the air receiver tank cylinder chamber. The weight of the floating piston and the psi must be predetermined and properly configured to get the proper results for a particular application and this would be obvious to one skilled in the art. When floating piston rises to a predetermined height in the cylinder in the air receiver tank, preferably high enough to allow for a constant flow of compressible fluid downstream and low enough to allow free movement such a breathing motion of the floating piston inside the cylinder of tank 300 then this may be defined as being primed. When the piston transfer duct is filled end to end with pistons then piston the transfer duct is defined as being primed.

7. Transporter—Is defined as the mechanism that transports the piston from the top or near the top of the transfer tank to the top or near the top side of the cylinder inside the air compressor. A piston transporter, transporter device, transporter, or piston transporter assembly can be used herein interchangeably and may have the same function. Two piston transporters can be used together as one piston transporter. Piston transporter assembly, transporter, transporter device, piston transporter could be defined as an operational device that transports a piston or other objects acting as a piston. One type of piston transporter could be a potential energy change device defined as being filled with liquid having density greater than air to enable a piston having a density smaller than the density of said liquid to gain potential energy from the density difference between the liquid and the pistons. Another transporting device could enable pistons to be transferred at predetermined timed intervals from the potential energy change device into the piston entrance of the air compressor. The piston transporter assembly is configured for transporting the piston from the piston exit to the piston entrance and deposit the piston into the air compressor, wherein the piston transporter enables the piston to be transferred from the piston exit to the piston entrance, the transporter is configured to do at least one, lower, drop, and deposit the piston into the cylinder at predetermined intervals allowing time to at least one compress the air in the cylinder, give time for the filling region to fill with air before another piston is introduced into the cylinder. A piston exit is defined as where the compressible fluid has been emptied from the fluid compression chamber and the piston is ready to exit the cylinder or air compressor. Everything below the first spent fluid compression chamber is a part of the piston transporter or transporter and could be configured to be a piston exit. The piston exit could be also given the name piston transfer, piston exit outlet, piston transfer outlet, and piston transfer duct. The pusher is part of the piston transporter and enables the piston to be held in place while the piston is being readied for transport. The pusher can also be defined and configured to hold the piston in place while the compressible fluid in the cylinder or air compressor is being compressed. A conveyor, hoist, lifting medium, moving medium or slide could be a transporter and configured and enable the piston to be transferred or transported and deposited into to the inside of the cylinder of the air compressor in any formation of the embodiments. Potential energy change device and the transfer tank are defined as synonymous and may be used interchangeably.

8. A tank is defined as a tube, pipe, cylinder, elongated vertical tank, or an elongated hollow tube and could be used interchangeably herein, and could be at least one, covered, with a bottom, bottomless, topless and could have the same functionality.

9. Safety—Only someone skilled in the art should work with the present invention.

10. Timing—Timing of the drop of the piston often varies according to a particular application or need such as mass, temperature or psi. Timing would be different for example for a cylinder one mile long verses 100 feet long and the number of chambers and mass required in each chamber varies the timing. The timing could be obtained and obvious to someone skilled in the art using the well documented gas laws discussed herein.

11. Guide—could be a guide for guiding a piston from the bottom entrance to the top surface of a liquid or water. A guide could be defined as anything that guides a piston such as a netting, pipe, tube, tank or a guide as shown on FIG. 2 or FIG. 7. The guide is the air compressor tanks themselves in a group of 3 or more as working members in a body of water such as a lake or ocean as seen on FIG. 4*a* and FIG. 4*b*. In a reservoir the walls could be a guide.

12. Valve is defined herein as a device that regulates, directs or controls the flow of a fluid by opening, closing, or partially obstructing various passageways. In an open valve, fluid flows in a direction from higher pressure to lower pressure. An actuator can be used in any valve element in these embodiments herein, that will stroke the valve depending on its input and set-up, allowing the valve to be positioned accurately, and allowing control over a variety of requirements. Some valves used with these embodiments and system are such as, but not limited to one-way check valves, shut off valves, flow valves, pop-off valves. It is intended any valve can be used by someone skilled in the art any where in the operation of this system and these embodiments discussed herein and be within the spirit of this invention.

13. Gauge is defined as an instrument for measuring or testing and any measuring instrument for measuring and indicating a quantity such as temperature, and pressure.

14. Duct, pipe, tube are used herein interchangeably and may the same function.

15. Air flow duct, air duct, and compressible fluid duct are used herein interchangeably and may the same function.

16. Air, atmospheric air, gas, plenum, ambient air, and fluid air may be used interchangeably and can have the same function.

17. Device and assembly could have the function and could be used interchangeably herein.

18. Programmable Logic Controller (PLC)—The PLC is designed for multiple inputs and output arrangements, extended temperature ranges, immunity to electrical noise, and resistance to vibration and impact. Programs to control machine operation are typically stored in battery-backed-up or non-volatile memory. A programmable logic controller (PLC) connected to sensors and actuators could be a preferred means for operating and controlling the system and its embodiments such as electric motors, pneumatic or hydraulic cylinders, magnetic relays, switches, solenoids, or analog outputs used in the system its embodiments and elements. The input/output arrangements may be built into a PLC and the PLC can be purchased off the shelf or online by someone skilled in the art. The PLC receives power from the system or air compressor as discussed herein.

19. The opening at the top or side of the air compressor is defined as being able to be used for introducing a piston or air into the air compressor. Their can be a plurality of openings in the air compressor. If the opening is introducing a piston the opening is larger in diameter than a piston. If the opening is just introducing air or a fluid the opening can be an inlet smaller than a piston.

DETAILED DESCRIPTION OF THE EMBODIMENTS

Figure 1B:
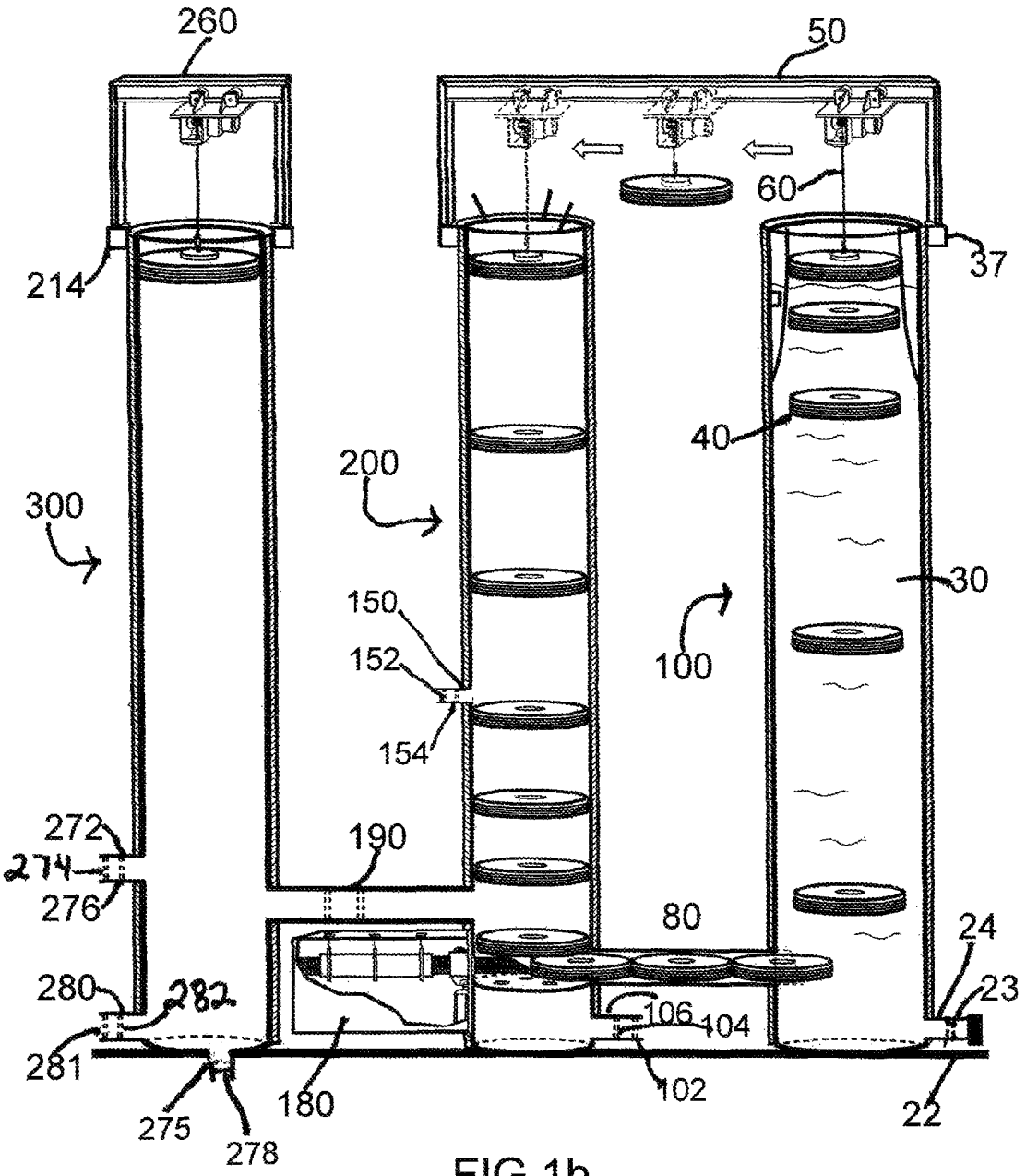
FIG. 1*b* shows a view of a system for compressing air.

In the following description, the use of "a," "an," or "the" could refer to the plural. All embodiments and elements are relative to each other in size, degree and other measurable characteristics. As herein depicted in FIG. 1 through FIG. 17 representing a general overview of the embodiments of the present invention. Referring to FIG. 1*a* and FIG. 1*b*, according to an embodiment, an air compressor system includes a transfer tank 100 connected by a piston transfer duct 80 to an air compressor 200, that is connected on the opposite side by an air flow duct 190 to a air receiver tank 300. On its opposite side air receiver tank 300 can be connected to air flow duct 190 for using a compressed air 130 locally or down stream. Tank 300 can have an air flow duct 190 attached to a compressible fluid outlet 280 where air flow is controlled by a flow control valve 281 and an one-way check valve 282. A mount 37 is located at the outside near top and connected to transfer tank 100 that is connected to a piston transport assembly 50 and the opposite end of piston transport assembly 50 is connected to a mount 128 that is located on the outside top portion and connected to air compressor tank 200. Piston transport assembly 50 is connected to an electromagnet assembly 60. Located near the top a mount 214, on each opposite side is connected to air receiver tank 300 that is connected to a hoist assembly 260 connected to an electromagnet assembly 240. A programmable logic controller (PLC) could be a preferred means for automation of electromechanical processes, such as controlling, operating and actuating the system and all its embodiments and elements on run time. The system or air compressor 200 provides a source of motive power. The systems motors being activated by the PLC connected to sensors and actuators provides a source of motive force. The system has a plurality of exits and entrances in the form of outlets, inlets, ducts, nozzles and spouts. Transfer tank 100 has a nozzle 24 located near its base for receiving fluid preferably water for filling transfer tank 100. The same nozzle 24 works for giving access for removing sludge or emptying out transfer tank 100. The flow and control of fluid for nozzle 24 is performed with an on and off valve 23. There is also an opening 38 larger than a piston 40 located at the top of transfer tank 100 for extracting piston 40. Transfer tank 100 could have one or more outlets for valves, meters, gauges, and other measuring and monitoring devices such as a monitoring outlet 111 controlled with an on and off valve 112 that could be fitted with an actuator as could any valve herein and a cap 21. Air compressor tank 200 has at least one of a condensation nozzle 106, a compressible fluid exit 118 that connects to air flow duct 190, and a gauge and valve outlet 150 for valves, gauges, and other measuring and monitoring devices. Air receiver tank 300 has a condensation nozzle 275 located at its lowest point controlled by a flow control valve 278 and an one-way check valve 277 at least one or more a gauge and a valve outlets 272 located above condensation nozzle 275. Air compressor tank 200 has a pusher assembly 180 connected to and passes through an outside wall 135 located above a bottom 207. Air compressor tank 200 has a platform 107 located below piston transfer duct 80. Piston 40 disposed horizontally on platform 107 is pushed forward pushing through piston transfer duct 80 by a pusher 172 that is given motive force by a motor 179 and a transmission 170. When piston transfer duct 80 is filled end to end with piston 40 the last piston 40 in line, is buoyant and is pushed through and out of piston transfer duct 80 into a liquid 30. Piston 40 then rises up transfer tank 100 and is caught by electromagnet assembly 60 a working member of piston transporter assembly 50 and is taken to air compressor 200 positioned and deposited into a cylinder 129 to start the cycle over. Air receiver tank 300 through an open air flow duct 190 will fill with compressed air 130 raising a floating piston 230 up as it fills and when it reaches the top it will send a signal via a sensor fitted with an actuator or a switch such as a limit switch, for more down stream consumption or to slow air compressor 200 down. Some of the purposes of air compressor 200 is to compress a compressible fluid 140 as defined herein such as air and generate heat for the generation of steam, wet steam, saturated (dry) steam, superheated steam, and supercritical water. Heat and pressure are fundamental to air compressor 200. Because air compressor 200 can deal with high pressures and temperatures the materials it is made of needs to be chosen by someone skilled in the art, examples of what could be used will be given herein. The entire system described above preferably sets on a flat level reinforced slab base a foundation 22 capable of holding this systems weight safely. Anything known by someone skilled in the art that will stay strong, firm, rigid, and level could also work such as solid rock, packed ground, or ice that stays solid year around and would support this system weight safely. Pusher 180, cranes, hoist, motors, actuating valves are preferably controlled by a Programmable Logic Controller (PLC) as defined and described herein or sensors and limit switches fitted with actuators attached at predetermined locations favorable to the particular application that would be obvious to one skilled in the art. The system configured with the proper timing of the lowering and depositing of piston 40 into cylinder 129 could function as bellows, an air compressor, heater, boiler, cooker, compressor or a pressurizer. The timing, weight of piston 40, and flow control varies for each particular application, as will be taught herein, and would be obvious to one skilled in the art. This system configured with tubing wrapped around and about the outside of air compressor 200 and with a source to feed water through the tubing and an outlet downstream could function as a source for steam, a boiler, heat exchanger, hot water heater or superheater. The steam or compressed air 130 from the system could be used as a source of energy to operate a turbine or turbo-generator providing motive power locally to the system and downstream. This system configured with a turbine connected inside or outside compressible fluid exit 118 or air flow duct 190 could be a source for electrical power. Air flow duct 190 could be the size of a wind tunnel. A plurality of air compressor 200 fed into air flow duct 190 could provide a large volume of compressed air 130 and would be in the spirit of the invention. This system configured with a tube wrapping around and about air compressor 200 with an entrance fitting 163 for a source of liquid 30 such as water and an exit outlet fitting 161 connected to a tube or pipe to channel steam could be a source of steam for a turbine that could provide a source of electrical power locally or down stream. This system could be configured to be used as a source of heat to convert saturated steam or wet steam into dry steam using heat generated through the compression of air. This entire system uses but a fraction of the energy it can produce when configured properly. The motive power produced by the system can be turned into motive force through the actuation of a PLC connected to sensors and actuators causing a motor to turn on, that can be enjoyed when the system is primed and allowed to operate by opening valves and letting piston 40 drop providing compressed air 130 and heat which could provide on-site motive power locally or downstream. Electricity could be produced with steam or compressed air 130 with this system configured properly as discussed herein. The system or air compressor 200 provides a source of motive power. Heat and pressure are fundamental to air compressor 200. It is important someone skilled in the arts configure and operate the system. Referring now to an embodiment illustrated on FIG. 2 that is a vertical air compressor 200 submerged in liquid 30, that provides for a smooth and reliable source of compressed air 130 for local and downstream use. Air compressor 200 is at base state, that is a state in which all valves and outlets are closed. Air compressor 200 is shown upright and submerged in liquid 30, such as water, in a reservoir 131 with a walls 169 defining an open cement watertight container that is rigid, reinforced, and strong, attached securely to a foundation 22 and a bottom 109 that provides an appropriate sealing system capable of being watertight. A bracket 142 and a connectors 141 are connected to the periphery of wall 169 and tank 160 at separate intervals as needed, to provide a rigid stable supporting of air compressor 200. Reservoir 131 is capable of being watertight. Extending upwardly from bottom 109 periphery and attached is a wall 121 defining a tank 160. The vertical central working hollow part 138 of an elongated hollow tube 136 defines a cylinder 129. The top most portion of cylinder 129 forms an opening 124 that is larger in diameter than piston 40 with a filling region 127 for fluid, that extends from the top of cylinder 129 down cylinder 129 to the top of the nearest piston 40 in cylinder 129. Opening 124 could function as at least one an entrance for piston 40, an ambient air entrance, and a fluid entrance. Tank 160 has one or more inlets, openings, outlets, ports, nozzles, and spouts. A liquid filter 102 and an one-way check valve 104 is fastened to or inside the periphery of nozzle 106 that is located at the lowest point of wall 121 configured to purge water and sediment. A programmable logic controller could be a preferred means for automation of electromechanical processes, such as controlling, operating and actuating air compressor 200, all its embodiments and elements on run time. The system or air compressor 200 can provide a source of motive power to the PLC connected to sensors and actuators, the system, air compressor 200, and all its embodiments and elements. A few of the purposes of air compressor 200 is to compress compressible fluid 140 such as air and generate heat for a source of heat for the generation of steam, wet steam, saturated (dry) steam, superheated steam or supercritical water. Heat and pressure are fundamental to air compressor 200. Safety is fundamental, only someone skilled in the arts should build, configure, or operate any of these embodiments or elements of air compressor 200 and all of its embodiments and elements. Examples of possible cycles of all or some embodiments and elements are listed below individually, however all cycles together could be configured to be one complete cycle.

Figure 2:
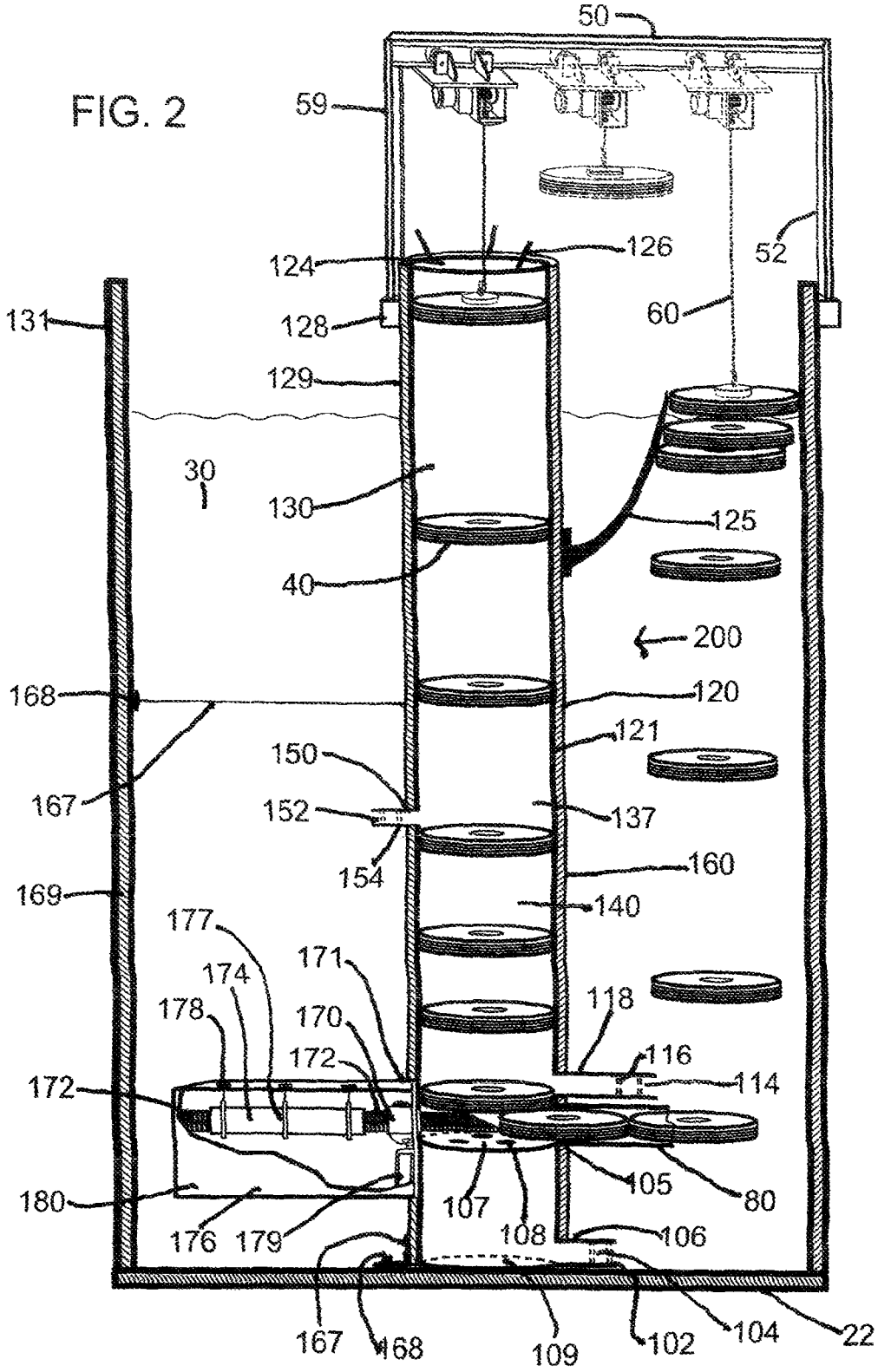
FIG. 2 shows a view of a vertical air compressor submerged in a liquid.
Figure 3:
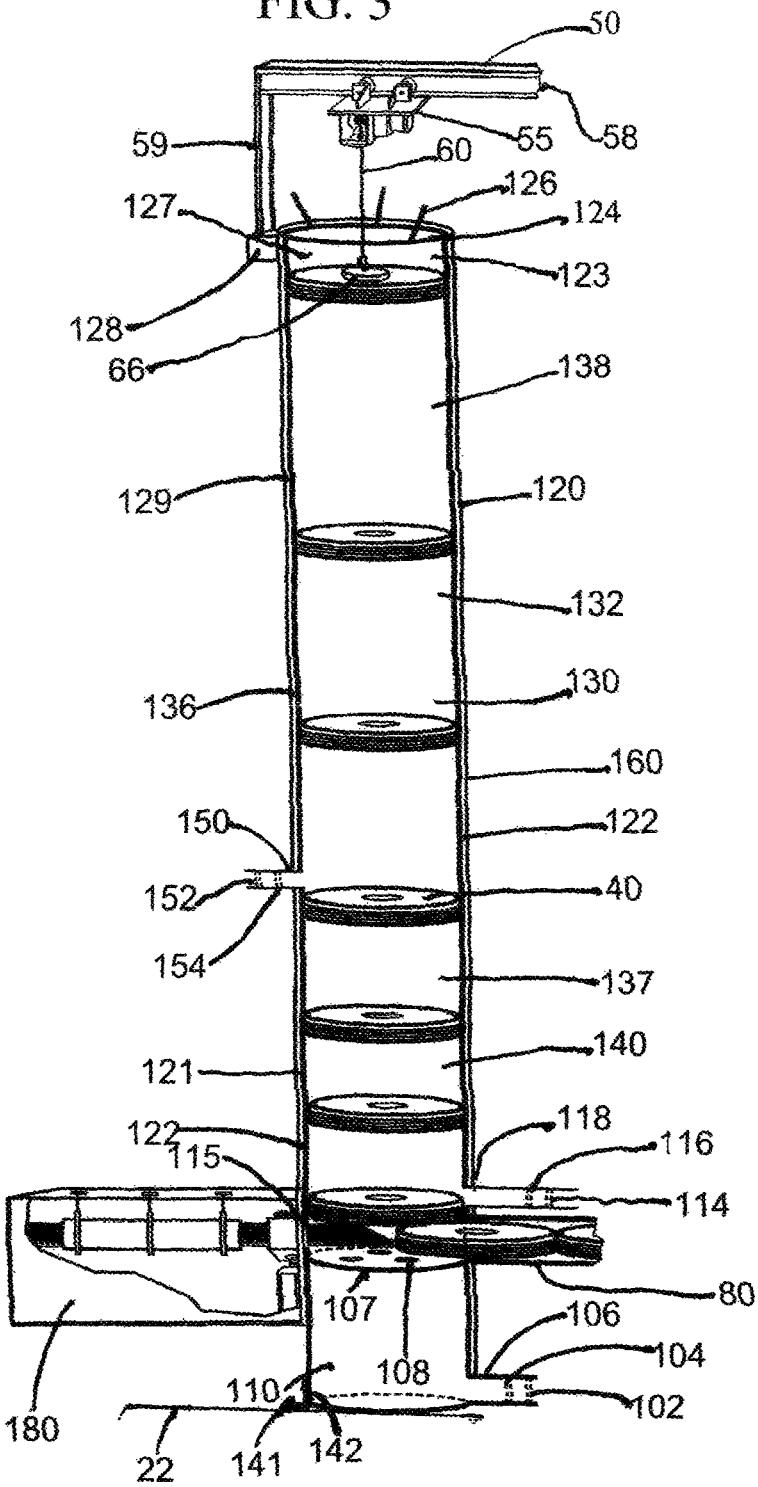
FIG. 3 shows a view of an air compressor out of liquid.
Figure 17:
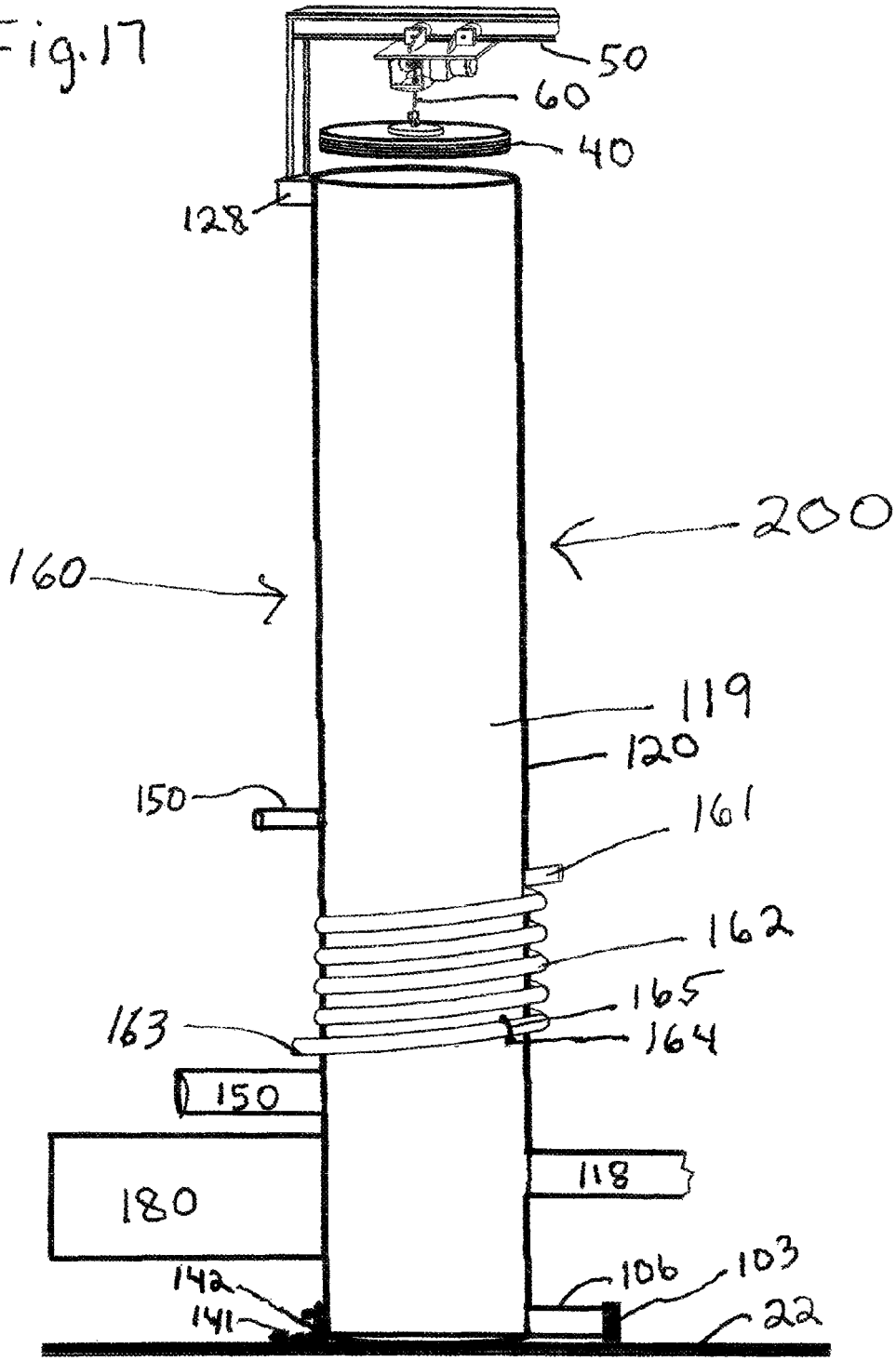
FIG. 17 shows a view of an air compressor with a tube wrapped around the outside.

Cycle one could be where piston 40 is lowered and deposited or dropped from the top of cylinder 129 opening 124, which is larger than the smaller piston 40, and the cycle ends when piston 40 finds equilibrium in a stable environment with the fluid inside cylinder 129 and is released and can move up and down freely in a stable environment in which forces substantially cancel one another. May read and view about where FIG. 2, FIG. 3 or FIG. 17 is discussed below herein.

Cycle two could be where one or more a compression chamber 132 or a fluid compression chamber 137 are in cylinder 129 capable of fluid isolation from each other and has free slideability up and down cylinder 129. May read and view about where FIG. 2, FIG. 3 or FIG. 17 are discussed herein.

Cycle three could be where fluid starts to flow into compressible fluid exit 118 that provides a whole in wall 121 of cylinder 129 providing fluid communication with air flow duct 190. When the flow controlled by an one-way check valve 116 and a flow control valve 114 has substantially emptied out fluid compression chamber 137 or compression chamber 132 the cycle has ended. May read and view about where FIG. 2, FIG. 3 or FIG. 17 are discussed herein.

Cycle 4 could be where fluid compression chamber 137 or compression chambers 132 have been emptied and substantially only piston 40 remain stacked and ready for pusher assembly 180 to move piston 40 into liquid 30 or where piston 40 is in a piston exit readied to be grabbed by piston transporter assembly 50. May read and view about where FIG. 2, FIG. 3 or FIG. 17 are discussed herein.

Figure 12:
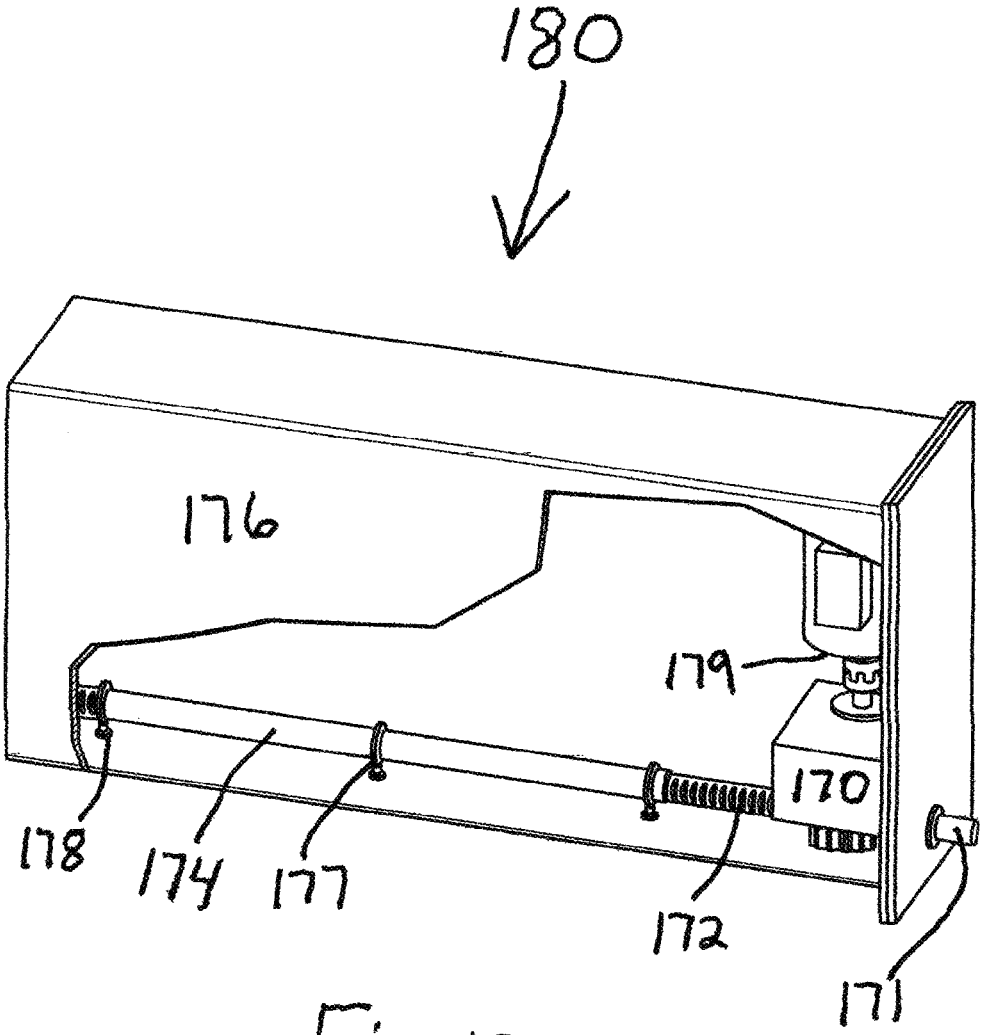
FIG. 12. shows a side sectional view of a pusher assembly.

Cycle 5 could be where pusher assembly 180 is actuated by a Programmable Logic Controller (PLC) and causes pusher 172 to push piston 40 into liquid 30. May read and view about where FIG. 12 is discussed herein.

Figure 9:
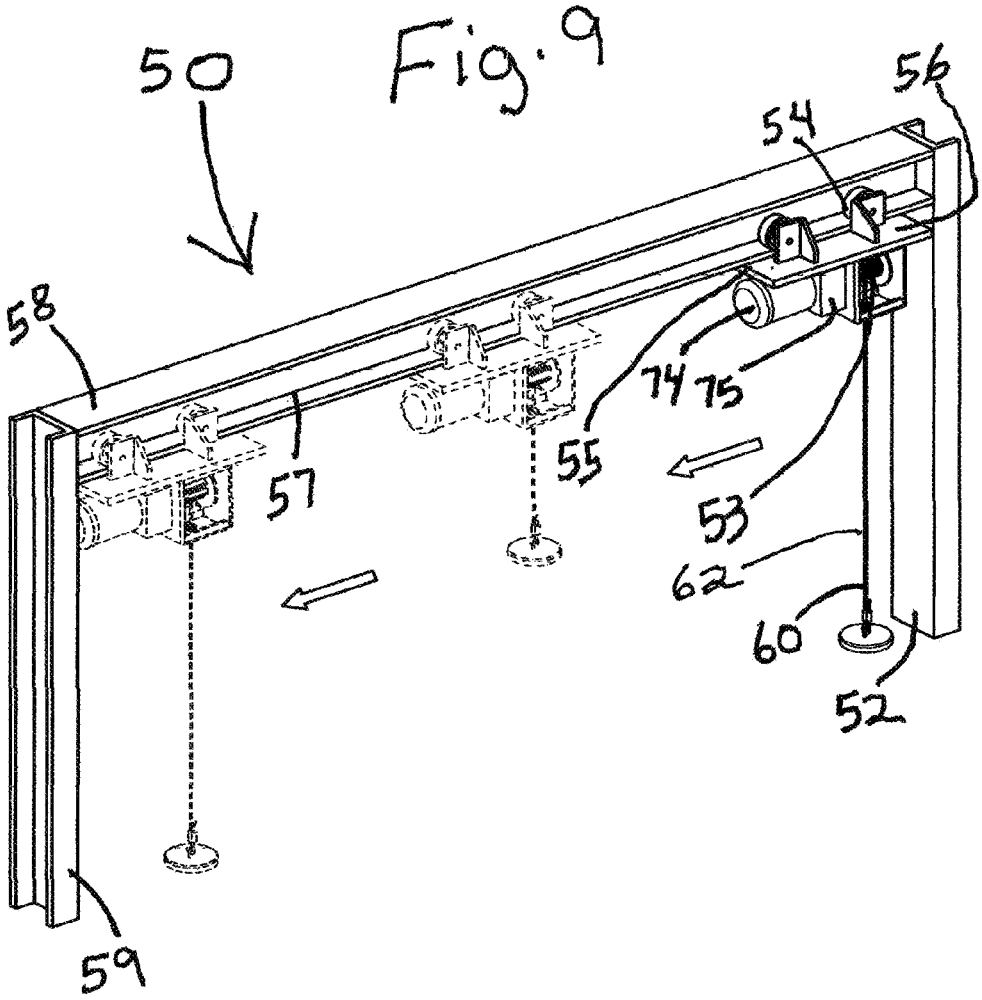
FIG. 9 shows an angled view of a piston transporter assembly.
Figure 10:
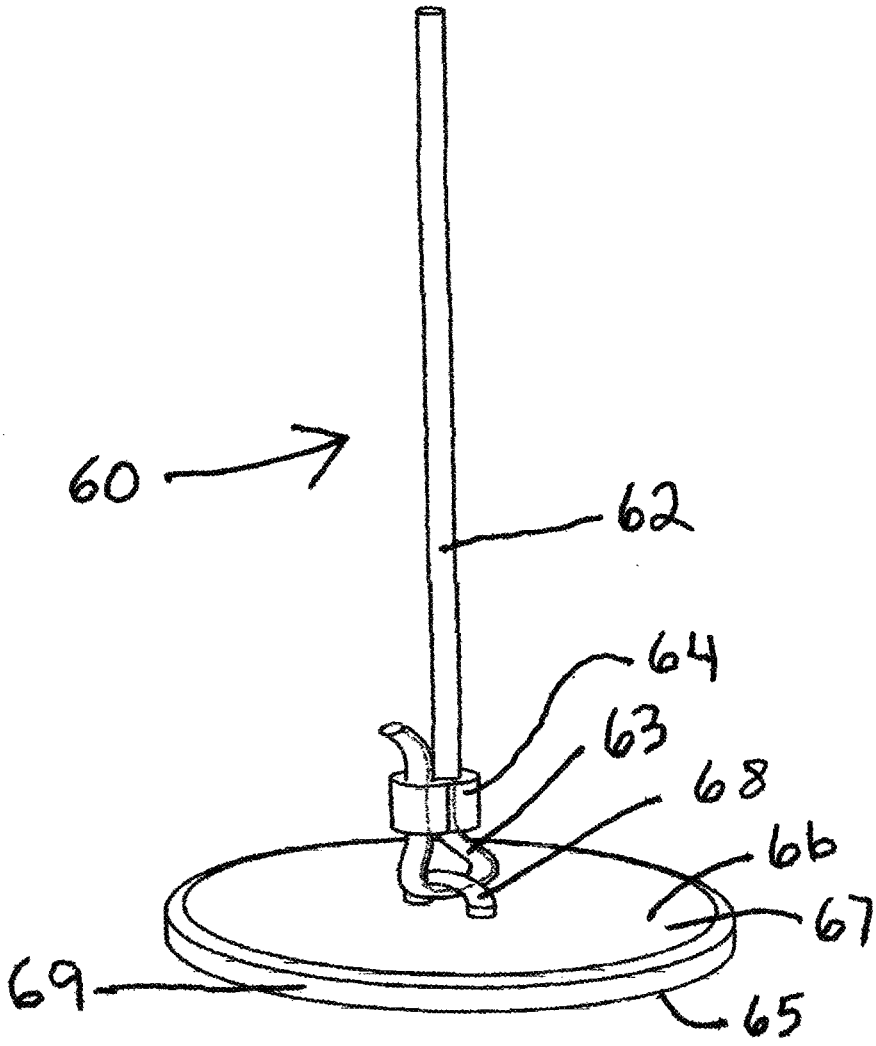
FIG. 10 shows an angled side view of an electromagnet assembly.
Figure 11A:
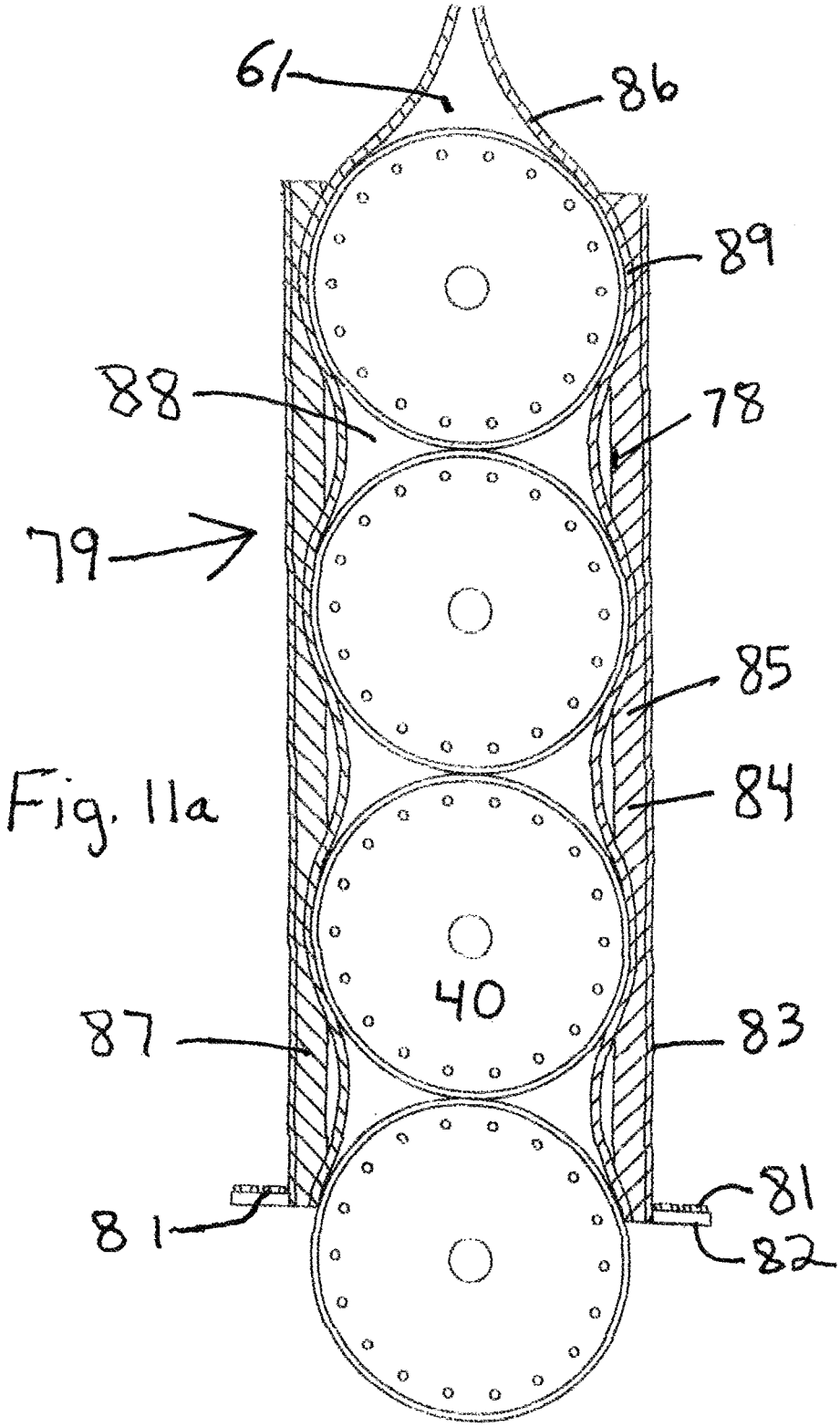
FIG. 11*a* shows an overhead view of a piston transfer outlet.
Figure 11B:
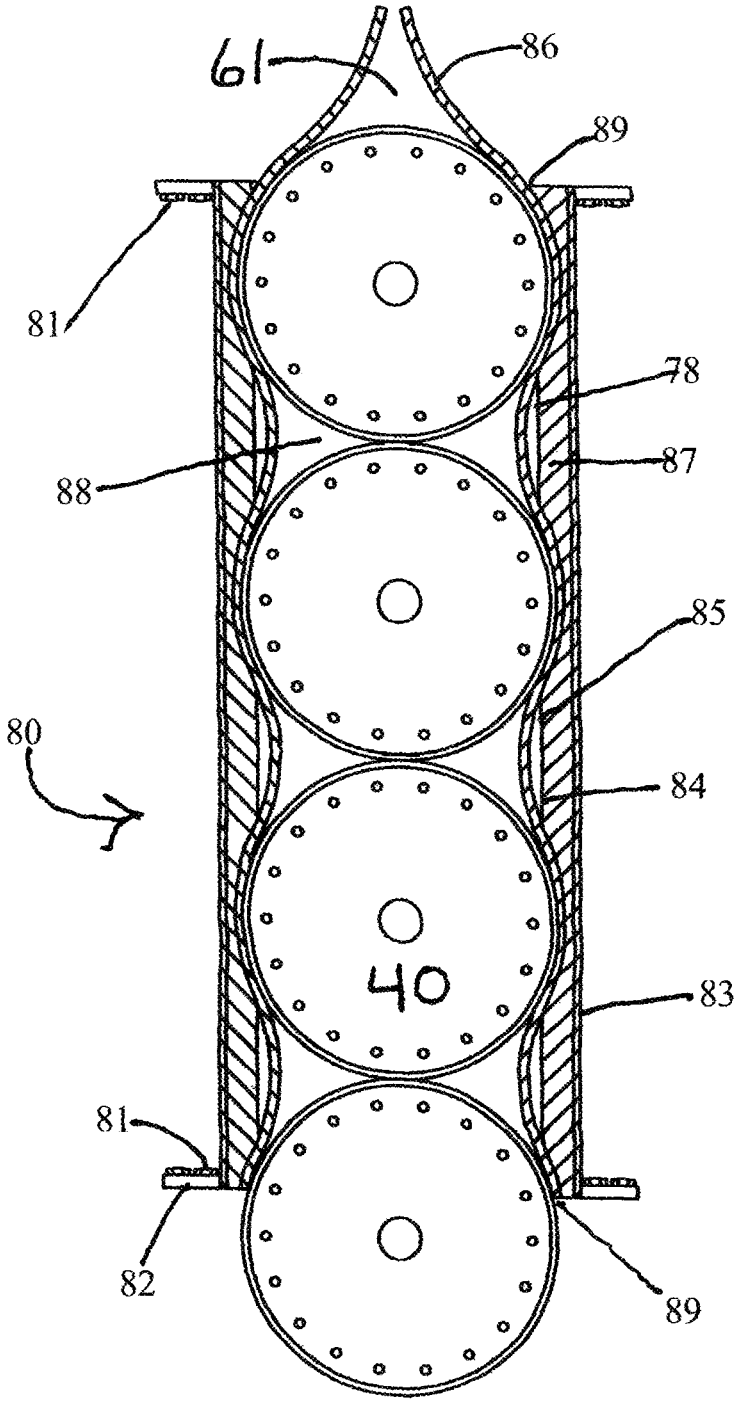
FIG. 11*b* shows an overhead view of a piston transfer duct.

Cycle 6 could be where after buoyant piston 40 is pushed into liquid 30 and it floats to the top of the surface of liquid 30 or the top where it can not float any further and is guided into place and positioned ready for piston transporter assembly 50. May read and view about where FIG. 9 is discussed herein.

Cycle 7 could be where Piston transporter assembly 50 collects and transports piston 40 to the side or top opening 124 and deposits piston 40 into cylinder 129 ready for cycle one to start over again. May read and view about where FIG. 2, FIG. 3, FIG. 9 or FIG. 17 are discussed herein.

Cycle 8 could be where compressible fluid 140 has at least one, flows through air flow duct 190, is recycled back into air compressor 200, flows into tank 100, is sent to be recompressed, or is used as someone skilled in the art has obvious need, to be used locally or down stream as discussed herein.

Cycles 1, 2 4, 5, 6, 7 should each be completed in the time it takes for cycle 3 to complete. This is a good rule of thumb only. This would allow for one piston 40 to start cycle one and another piston 40 to complete cycle 7 and be ready to start cycle one making for a smooth transitional rotation of piston 40 through all individual cycles.

Figure 13:
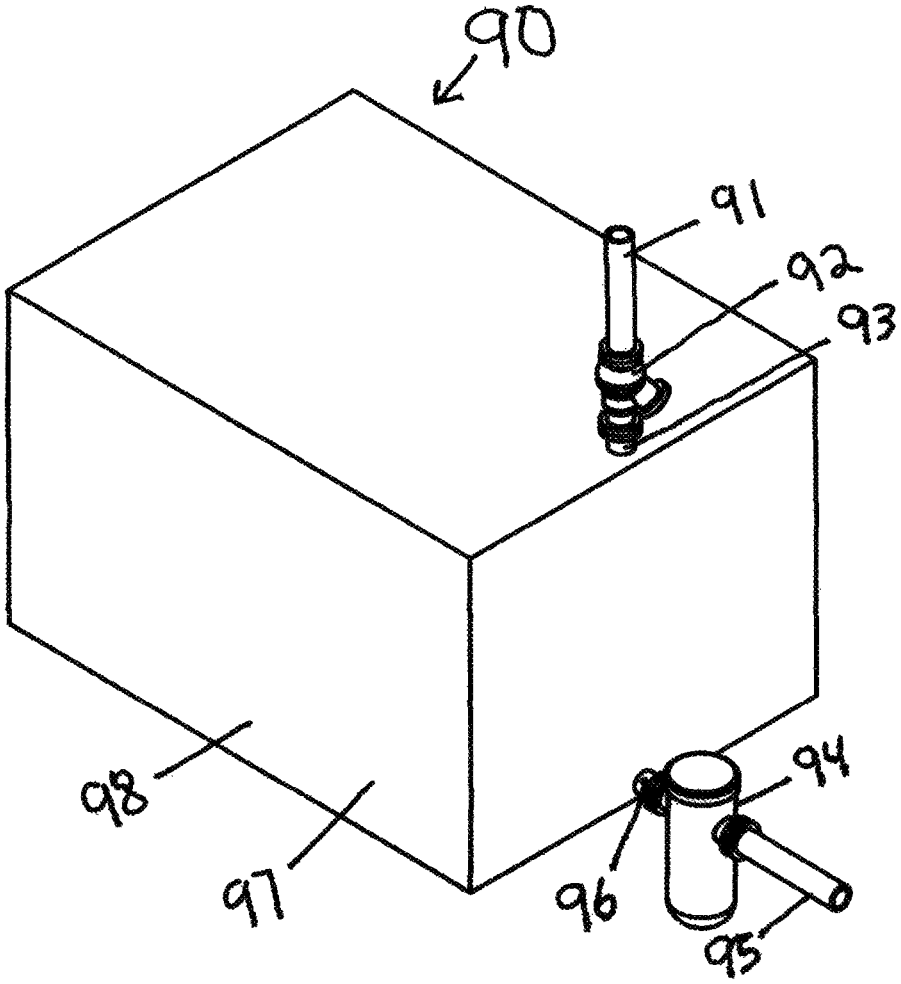
FIG. 13 shows an angled outside view of a condensation tank.

Condensation tank assembly 90 could be connected to a pipe, hose, or tube which is another aspect of FIG. 2 that is an embodiment viewed on FIG. 13, comprising a condensation tank 98, having an inlet 93 connected to pipe 91, that is connected to one-way check valve 92. At its lowest point condensation tank 98 with walls 97 defining a vessel such as a tank or bladder that enjoys nozzle 96 connected to a pipe 95, connected to a liquid filter 94. Pipe 95 is configured to carry condensation downstream using the force of gravity, enjoying a descending elevation. Condensation tank 98 is preferably sufficiently positioned below all condensation outlets by at least one or more meters, allowing condensation to drain evenly through pipes 91 using the force of gravity, enjoying a descending elevation into condensation tank 98. Condensation tank 98 could be generic and purchased off the shelf or online being readily available to some one skilled in the art as are all elements in the present embodiment. Water, may be thousands of gallons a year can be used for domestic purposes. If deep water air compressor 200 is out to sea powering a ship or factory, clean pure water could be another advantage enjoyed.

Referring now to another aspect of FIG. 2 positioned and configured to be accessible is gauge and valve outlet 150 that can be male or female and can have an air flow valve 152 and one-way check valve 154 connected by means of a pipe, or disposed and connected inside the periphery of gauge and valve outlet 150. Valve is defined herein as a device that regulates, directs or controls the flow of fluid by opening, closing, or partially obstructing various passageways. In an open valve, fluid flows in a direction from higher pressure to lower pressure. An actuator can be used in any valve element in these embodiments herein, that will stroke the valve depending on its input and set-up, allowing the valve to be positioned accurately, and allowing control over a variety of requirements. Some valves used with these embodiments and the system are such as, but not limited to one-way check valves, shut off valves, flow valves, pop-off valves. It is intended any valve can be used by someone skilled in the art any where in the operation of this system and these embodiments discussed herein and be within the spirit of this invention. Gauge and valve outlet 150 could be male or female and use pipes to connect the reading devices or be connected directly to gauge and valve outlet 150. Any number of gauges could be positioned and configured to be read here such as temperature, moisture, and pressure gauges. It is intended a gauge is defined as any of a variety of measuring instruments and any measuring instrument for measuring and indicating a quantity such as temperature, and pressure. Any gauge can be used by someone skilled in the art any where in the operation of these embodiments and the system and be within the spirit of this invention.

Referring now to another aspect of FIG. 2 which is compressible fluid exit 118, it could be male or female, passing through wall 121 of air compressor 200. The location will be where the particular application will be enjoyed, usually near the lower portion of tank 160, however it could be positioned by someone skilled in the art where it is most needed for a particular application. It can be placed for various benefits such as an example, removing compressible fluid 140 from fluid compression chamber 137 at various pressures or temperatures depending on a particular application. Compressible fluid exit 118 is defined also as a compressible fluid outlet or a compressible fluid flow outlet herein and can be used interchangeably and can have the same function. Compressible fluid exit 118 connects to air flow duct 190, allowing for fluid communication between cylinder 129 and air flow duct 190, the connection could be a pipe, duct, tube, or tank. Air flow duct 190 can connect directly to compressible fluid exit 118 with a bracket 186 and a connectors 184. Air flow duct 190 can have a larger diameter than the smaller diameter of compressible fluid exit 118 so air flow duct 190 would fit snugly over compressible fluid exit 118 and connect securely. Compressible fluid 140 flow could be controlled inside outlet 118 by at least one of an one-way check valve 196, an air flow regulator 195, and a mass flow controller (MFC) 188. Compressible fluid exit 118 can be male, female, moulded or could be extended in length.

Figure 8:
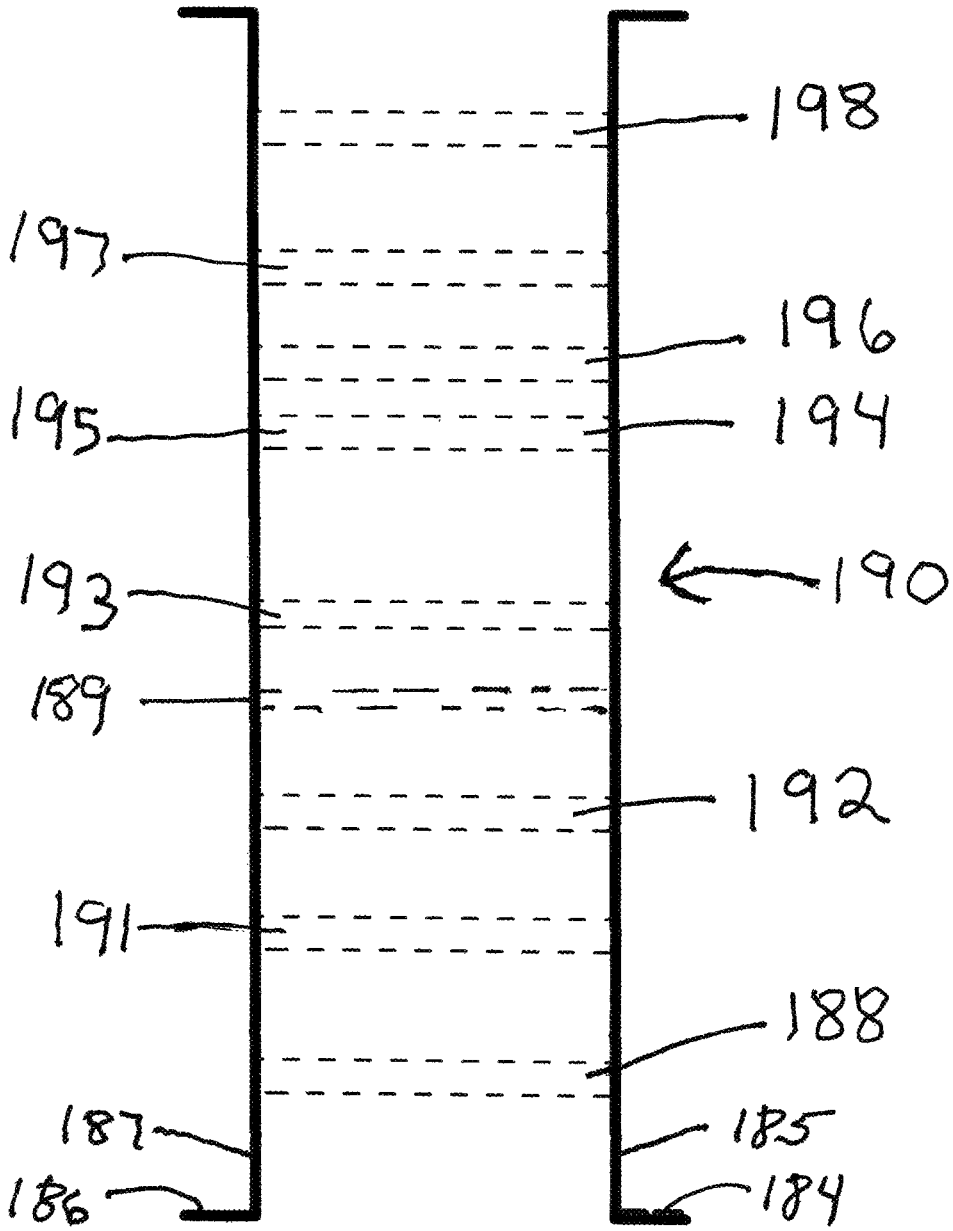
FIG. 8 shows a view of an air flow duct.

Referring now to another aspect of FIG. 2 is an embodiment viewed on FIG. 8 that is an embodiment of an air flow duct 190 connected securely to compressible fluid exit 118. The purpose of air duct 190 is a controlled tubular passage for fluid such as compressed air 130 or compressible fluid 140. Compressible fluid 140 flow could be controlled by at least one of one-way check valve 196, air flow regulator 195, and mass flow Controller (MFC) 188. Air flow duct 190 could comprise at least one or more of the following a turbine 189, a turbo generator 198, an aftercooler 197, one-way check valve 196, air flow regulator 195, a heater 194, a centrifugal fan 193, a pressure regulator 192, an air filter 191, and mass flow controller (MFC) 188 or any other element, gauge or valve that could be included that would add positive function to air flow duct 190 and would be obvious by one skilled in the art. These elements can be connected depending on the particular applications needs, at intermediate stations securely to an inner wall 187 or an outer wall 185 starting at one end and along several intermediate stations as the application or someone skilled in the art has need. For example a turbine can be connected within the periphery of inner wall 187. The transmission can go directly behind the turbine blade or connect directly to a generator connected to the periphery of inner wall 187, or pass through outer wall 185 and provide motive force to an off the shelf generator attached to outer wall 185, depending on a particular applications needs. Air flow duct 190 can take the form of a duct, pipe, hose, wind tunnel, tube, or any other form capable of allowing and containing fluid, such as compressed air 130 or compressible fluid 140 configured to flow safely. Air flow duct 190 can be rigid or flexible and connected to compressible fluid exit 118 using a brackets 186 with a connectors 184. Air flow duct 190 can be configured to be connected to a plurality of air compressors 200 and be in the spirit of the invention. Air flow duct 190 can take the shape of a wind tunnel. Compressed air 130 inside air flow duct 190 could be used by an end user or the system to produce energy, regulate temperatures, (example inside buildings), operating machinery, tools, powering vehicles and a multitude of other uses readily known by someone skilled in the art.

Compressed air 130 could flow through air flow duct 190 to a turbine directly connected to an electric generator for the generation of electric power. Often applications now use reduction gears or an intermediate electrical step, where the turbine is used to generate electricity, which then powers an electric motor connected to the mechanical work load that could produce local or down stream electricity which would be in the spirit of the present invention. Cylinder 129 that is larger in diameter than the smaller in diameter piston 40. Cylinder 129 is defined as a central working hollow part 138 or the space in which piston 40 and fluid compression chamber 137 travels. As the sufficiently weighted piston 40 and fluid compression chamber 137 move down the slick an inner wall 122, by the force of gravity filling region 127 is formed creating a low pressure area for high pressure air to rush into opening 124 of cylinder 129. When another piston 40 is deposited into cylinder 129, piston 40 traps the air and creates another fluid compression chamber 137. The air is squeezed together as fluid compression chamber 137 moves down cylinder 129 with bottom 109 or more compressible fluid chambers 137 trapping the air in a contained air-tight area configured to be capable of fluid isolation inside cylinder 129. Cylinder 129 is configured to have opening 124 that can be defined and configured as at least one a compressible fluid entrance, and a piston entrance, located at the top or side of cylinder 129 larger in diameter than piston 40. A Piston entrance opening 124 can be placed on the side of cylinder 129 and be within the scope of the invention. Piston 40 forced by gravity down cylinder 129 compresses at least one of air, fluid, compressible fluid 140, fluid compression chamber 137, and compression chamber 132. Cylinder 129 is configured to have one or more outlets larger than its smaller contents allowing the contents sufficient room to exit cylinder 129. Compressed air 130 could be placed in air receiver tank 300 for local use or a storage cavity such as a cave for downstream use as needed by an end user, such as a power plant. It should be noted with multiple air compressors 200 working together there may not be a need for storage other than air receiver tank 300 to maintain constant surgeless flow.

The amount of mass compressed air 130 is only limited by the number and size of air compressor 200 used and functioning as working members together in a particular application. It should be noted an application can be built with backups and enjoy the high reliability, some types of power suppliers do not enjoy now such as no power outages and the time and expenses getting them back up and running. The circumference of larger pipe is much more expensive than a smaller circumference pipe. A plurality of pipe or tubes can be used with a smaller circumference to reduce cost and be within the spirit of the present invention. Shapes of pipe can be changed and be within the spirit of the invention such as square, rectangular, or oval to reduce space in between the smaller pipe. The size and shape of piston 40 can change along with all other elements and embodiments in the system and air compressor 200 to be relative to each other depending on the particular application. Compressed air filters remove the oil and dirt content while compressed air dryers remove water vapor before air reaches the point of use they may be used by someone skilled in the art anywhere enjoyed and be in the spirit of the present invention. It would be obvious to someone skilled in the art wind turbines creating energy could enjoy large volumes of air flow (wind) created by multiple properly timed and configured air compressor 200 that could create large volumes of hurricane force winds in a wind tunnel or air flow duct 190. Air flow duct 190 can be configured to function as an wind tunnel. Warm air in a wind tunnel could keep the wind turbines from icing up and their cables and ladders from freezing in extremely cold climates. It could eliminate the need for tall ladders that are unsafe in high winds and ice. Referring now to another aspect of FIG. 2 which is an embodiment viewed on FIG. 9 that shows an angled perspective view of piston transporter assembly 50. Piston transporter assembly 50 comprises and is operated by a hoist 55, on a trolley 56 with a rollers 54 or cam followers that runs horizontally along a rails 57, fitted on a single rigid overhead I-beam such as a horizontal frame member 58. Horizontal frame member 58 on one side is connected to vertical a beam frame member 59 fastened firmly to and resting on the top of mount 128 fastened to the top side of tank 160 on its opposite side a beam frame member 52 is fastened to and resting on the top of a mount 134 or mount 37 attached to reservoir wall 169 or an outside wall 32 respectively as can be viewed on FIG. 2, FIG. 7, or FIG. 9. Hoist 55 is a device with a source of motive power and is operated by an electric or pneumatic a motor 74 and a transmission 75 providing a controlled application of motive force and mobility configured for lifting or lowering a load by means of a drum 53 around which a wire rope 62 connects to and wraps around. Wire rope 62 on the opposite end attaches to electromagnet assembly 60. Hoist 55 could be configured to be electrically, manually, or pneumatically driven and could use chain, rope, fiber or wire rope 62 as its lifting medium. Wire rope 62 being preferred. A Programmable logic controller (PLC) as described and defined herein could be configured and programmed to control and operate piston transporter assembly 50 on run time and could be preferred. Pneumatic tubes and cylinders with solenoids and relays could be configured to operate piston transporter assembly 50. You could use limit switches as such. All switches in all embodiments can be activated using a PLC, manually or by an element actuating the switch. A switch is actuated manually or by piston 40 causing hoist 55 to power on motor 74, giving motive force to operate transmission 75, and drum 53 forward lowering positioned piston 40 to smoothly glide down cylinder 129 or inner walls 122 of elongated hollow tube 136 with bottom 109 at base state, making the mass of air smaller within tank 160. When the force pushing down on piston 40 equals the force pushing up on piston 40 inside cylinder 129 a limit switch actuates shutting off electricity to electromagnet 66 releasing piston 40 and a preset switch actuates shutting off motor 74 forward movement to stop. Another switch actuates causing motor 74 to operate in reverse along with transmission 75 and drum 53 rolling up wire rope 62 onto drum 53. Another switch actuates at a preset position turning off electricity causing the reversing of motor 74 to stop and another limit switch is configured to actuate causing piston transporter assembly 50 to push horizontally forward along rail 57 to chase another piston 40. When electromagnet 66 is positioned over the center of piston 40 a preset limit switch is configured to actuate causing hoist 55 to stop horizontal movement and another switch actuates motor 74 starting and operating forward movement of drum 53 lowering electromagnet 66. When piston 40 is caught a switch actuates to turn on power to electromagnet 66 causing it to attach safely and firmly to piston 40. A preset switch actuates causing hoist 55 to power off. Another switch actuates configured to power on, providing a source of motive power causing to operate motor 74, transmission 75 and drum 53 to reverse rolling up wire cable 62 onto drum 53. A switch actuates that is configured to power off hoist 55 and another switch triggers and actuates causing to turn hoist 55 on configured to cause hoist 55 to push horizontally forward on rails 57 to return to air compressor 200 to end a cycle and piston transporter assembly 50 is configured to start a cycle all over again. All elements such as a Gantry crane can be purchased off the shelf or on line and are readily available. Air compressor 200 is primed when a preset number of pistons 40, is in air compressor 200 that is a variable dependant on the length, temperature, or psi of compression chamber 132 needed in a particular application, eight in the present example. Compressing air at 100 psi could take 5 or 6 piston 40 at 20 pounds each into cylinder 129 that could be 125 feet to 150 feet in length, in timed separate intervals as discussed herein, and about 6 more on the transporter side to rotate the piston 40 smoothly through the cycles and back again to cycle 1 to start all over again. Compressor 200 basically has two separate functioning mechanical operations. The compressing side is from the top of cylinder 129 to where the compressed air in compression chamber 132 is exhausted. The piston transporter side is everything else. In other words where the piston gets readied to exit cylinder 129 and everything in between until piston 40 is deposited back into cylinder 129. One is the compressing of the fluid. Two is the transporting of piston 40 back to the top of cylinder 129 and depositing piston 40 into cylinder 129 to start the cycles over again. The weight of piston 40 is a variable dependent on psi and mass needed in compression chamber 132 for a particular application. Here is how the math works. Piston 40 is lowered, into cylinder 129 that is larger in diameter than the smaller piston 40 until the fluid pushes upward equally as much as the weight is forcing piston 40 downward. Piston 40 finding equilibrium is released. This creates first compression chamber 132. Another piston 40 is lowered into cylinder 129 until the fluid pushes upward equally as much as the weight is forcing piston 40 downward, both pistons 40 and cylinder 129 being capable of fluid isolation. The second piston 40 is released. This creates a second compression chamber 132. This continues until cylinder 129 is primed. Compress the air in cylinder 129 until the volume is half, with the pressure doubled and the volume halved that heat would cause the air molecules to bounce around inside even more violently than they did at ambient pressure. Heat is kinetic energy in between molecules and atoms. Double the pressure, double the temperature. The laws of thermodynamics state that an increase in pressure equals a rise in heat and compressing air creates a proportional increase in heat. Boyle's law explains that if a volume of a gas (air) halves during compression, then the pressure is doubled. Charles' law states that the volume of a gas changes in direct proportion to the temperature. These laws explain that pressure, volume and temperature are proportional, change one variable and one or two of the others will also change, according to this equation: $(P1\ V1)/T1=(P2\ V2)/T2$. When applying this to a compressor, air volume (or flow) and air pressure can be controlled and increased to a level that suits a particular application. Piston transporter assembly 50, transporter, transporter device, or piston transporter can be defined as a working member that transports a piston or other objects acting as a piston. Electromagnet 66 or electromagnet assembly 60 could be a part of piston transporter assembly 50. A crane can be defined as a transporter or a piston transporter. A conveyor, crane, hoist, chute, slide, dump, or chaser could be defined as a transporter. Hoist 55 could be an overhead crane or Gantry crane operated and controlled by a Programmable logic controller (PLC) all of which could be generic and purchased off the shelf or online being readily available to someone skilled in the art as are all elements in the present system or embodiments. A programmable logic controller as defined and discussed herein could be a preferred means for automation of electromechanical processes, such as controlling, operating and actuating piston transporter assembly 50 or a piston transporter and all its elements on run time. The system or air compressor 200 provides a source of motive power to all the embodiments and elements. The systems motors being activated by the PLC provides a source of motive force. Piston transporter assembly 50 purpose is to chase down piston 40, grab it, and return it to air compressor 200 where it at least one aligns, positions, deposits and disposes piston 40 into cylinder 129 to start the cycle over again. Piston transporter assembly 50 is defined as the mechanism that can transport piston 40 from the top or near the top of tank 100 to the top or inside of cylinder 129 a working member of air compressor 200. A piston transporter, transporter device, transporter, or piston transporter assembly 50 can be used herein interchangeably and may the same function. Piston transporter assembly 50, transporter, transporter device, piston transporter could be defined as an operational device that is a working member that transports piston 40 or other objects acting as a piston 40. One type of piston transporter could be a potential energy change device filled with liquid 30 having a density greater than air to enable piston 40 having a density smaller than the density of liquid 30 to gain potential energy from the density difference between liquid 30 and piston 40. Another transporting device could enable piston 40 to be transferred at predetermined timed intervals from the potential energy change device, that could be another name for transfer tank 100, and deposit piston 40 into the piston entrance or opening 124 of air compressor 200. The piston transporter or piston transporter assembly 50 is configured for transporting the piston 40 from the piston exit to the piston entrance, wherein the piston transporter enables the piston 40 to be transferred from the piston exit to the piston entrance, the piston transporter is configured to do at least one, lower, drop, and deposit piston 40 into cylinder 129 at predetermined intervals allowing time to at least one compress the air inside cylinder 129, for the filling region 127 to fill with air, for cylinder 129 to replenish with compressible fluid before another piston 40 is introduced into cylinder 129. A piston exit is defined as where the piston 40 has emptied compressible fluid 140 from fluid compression chamber 137 and is ready to exit the cylinder 129 or air compressor 200. The piston exit is also given the name piston transfer, piston exit outlet, piston transfer outlet 79, and piston transfer duct 80. Outside straps could be used to increase the strength of cylinder 129 and air compressor 200 or any other embodiment. The length of cylinder 129 could be increased by attaching more than one cylinder 129 together end to end using couplings, flanges, fasteners, straps and other lengthening mechanisms that are obvious and known by someone skilled in the arts. Referring now to another aspect of FIG. 2 that is an embodiment viewed on FIG. 10, which shows an angled side view of electromagnet assembly 60 another embodiment of air compressor 200. The purpose of electromagnet assembly 60 is to catch, hold, and release piston 40 as needed. Electromagnet assembly 60 comprises an electromagnet 66, wire rope 62, a loop 63, a swage sleeve clamp 64, an electromagnet bottom surface 65, an electromagnet top surface 67, an ubolt 68, and a side 69 of electromagnet 66. Wire rope 62 is configured to be fastened and wound onto drum 53 at one end and looped through ubolt 68 and configured to be connected by swage sleeve clamp 64 securely on the opposite end. Ubolt 68 is fastened to at least one electromagnet 66, electromagnet top surface 67 and implanted in electromagnet 66 center area securely. Electromagnet 66 is configured to be powered on and off by the current being applied and not applied respectively. For safety electromagnet 66 is configured to pick up several times the weight of piston 40. A coating such as plastic can be put around the outside of wire rope 62. A Programmable logic controller (PLC) connected to sensors and actuators as described and defined herein could be configured and programmed to control and operate piston transporter assembly 50, electromagnet assembly 60 and all other embodiments and elements discussed herein. Electromagnet assembly 60 could be a functioning working member of piston transporter assembly 50. Some advantages of electromagnet 66 is that the magnetic field can be rapidly manipulated by controlling the amount of electric current, it is reliable, clean and the electricity or compressed air can be produced on-site that is a source of motive power to operate piston transporter assembly 50 that operates and causes to function electromagnet 66. Referring now to another aspect of FIG. 2 that is an embodiment viewed on FIG. 12 that shows a perspective cutaway view of pusher assembly 180 that comprises transmission 170, a bushing 171, pusher 172, a pusher casing 174, a pusher housing 176, an eye bolt 177, an eye bolt connector 178, and motor 179 all of which could be generic and purchased off the shelf or online being readily available. A pusher outlet 115 has a bushing 171 with pusher 172 passing through the center and is capable of fluid isolation. The purpose of pusher 180 is to provide motive force to urge pusher 172 smoothly into piston 40 and push them end to end through a central passageway 88 located in piston transfer duct 80 and into liquid 30. A programmable logic controller is a preferred means for automation of electromechanical processes, such as controlling and actuating pusher assembly 180 and all its elements. Pusher assembly 180 is incased in a pusher housing 176 made of metal or plastic, capable of being hermetic and fastened to outside wall 135 of tank 160. The pusher 172 It could be a conveyor, chute, or any means to hold piston 40 in place as it passes through passageway 88 or holds it in place to let it fall by gravity or pushing means one or more at a time out of air compressor 200 on to a platform, raft or other transferring means such as water. Pusher assembly 180 is a device with a source of motive power and is operated by motor 179 and transmission 170 providing a controlled application of motive force, such as an electric motor, pneumatic or hydraulic cylinders, configured for pushing, pusher 172. Piston 40 could actuate a limit switch that activates and causes to start drive motor 179, that could be a three-phase variable speed reversible motor 179, causing transmission 170 and gears to rotate forward causing pusher 172 with teeth to urge straight forward advancing Alpha piston 40 into a straight horizontal contiguous formation of piston 40 passing piston 40 already in piston transfer duct 80 straight forward through central passageway 88 of piston transfer duct 80 causing omega piston 40 to pass through and exit into the inside base of transfer tank 100 or liquid 30. Piston 40 diameter is smaller than the larger diameter of an inner wall 34 of transfer tank 100. Inside transfer tank 100 piston 40 actuates a limit switch that activates motor 179 causing it to power on in reverse causing transmission 170 and gears to rotate in reverse causing pusher 172 to urge straight backward to its original position where a limit switch actuates and deactivates motor 179 to stop, ready for the next cycle. Motors that would also work in place of motor 179 are an electric, pneumatic, vane, or, an air motor, but other types of motors known to those skilled in the art would also work. Motor 179 is disposed and connected to pusher housing 176 and outside wall 135 of tank 160. Motor 179 is meshed together with transmission 170, to operate pusher 172 meshed together with transmission 170. A hydraulic drive system, or a pneumatic system that can power cylinders and other pneumatic devices through solenoid valves and relays that can provide motive force to move pusher 172 is in the spirit of the present invention. Rigid, level pusher 172 passes through pusher casing 174 smoothly with little resistance that passes through eye bolt 177 connected to pusher housing 176 by connectors 178 in order to give the entire unit stability. Bushing 171 can be metal, plastic or an elastomeric rubber being capable of fluid isolation to the inside of pusher housing 176 and providing a pathway for pusher 172 to pass through wall 121 with substantially little resistance and capable of hermetic fluid isolation with cylinder 129. Pusher housing 176 can be configured to attach to tank 160 in any direction and pusher 172 can be flexible and still be in the spirit of the embodiment. The working members inside pusher housing 176 can be configured to be powered by electronic, pneumatic, hydraulics, manually or any mixing or matching where applicable and still be in the spirit of the embodiment. Pusher device, transporter, or pusher assembly 180 could be defined as anything that can push, carry, move, pull or drop piston 40 into at least one liquid 30, potential energy change device, the base of transfer tank 100 and deposit piston 40 into cylinder 129 or where one skilled in the art would have need for it in a particular application would be in the spirit of the invention. The terms pusher 172, pusher device, transporter, and pusher assembly 180 could be used interchangeably and have the same functionality. Pusher assembly 180 could be part of the piston transporter. Pusher assembly 180 could be configured to enable piston 40 to be held in place while piston 40 is being readied for transport. Pusher assembly 180 can also be configured to enable piston 40 to be held in place while compressible fluid 140 in at least one cylinder 129, air compressor 200 and compressible fluid chamber 137 is being compressed. Pusher assembly 180 can also be configured to enable piston 40 to be held in place while compressible fluid 140 in compressible fluid chamber 137 is being emptied through compressible fluid exit 118 or wherever someone skilled in the art would enjoy it to be emptied such as directly into air flow duct 190. Pusher assembly 180 could be hermetic in a casing or housing. The purpose and function of pusher assembly 180 and pusher 172 can be to give motive force to piston 40 to exit air compressor 200. Motive power is supplied by the system and its embodiments via water, oil, steam, wind, compressed air, and electricity used to impart motion to such as a motor, embodiments and their elements impelling action such as movement. Pusher assembly 180 and pusher 172 could be in the form of a hydraulic cylinder such as but not limited to a single acting or double acting cylinder. It could be in the form of a pneumatic cylinder such as but not limited to a Multi-stage, telescoping cylinders, and rodless cylinders. Although pneumatic cylinders, and hydraulic cylinders will vary in appearance, size and function the particular use of one or more for a particular application would be in the scope and spirit of the present invention. All of the mechanical systems impelling action to embodiments and elements of the present invention discussed herein are within the scope of the invention.

Referring now to another aspect of FIG. 2 that is an embodiment viewed on FIGS. 6*a*, 6*b*, 6*c*, 6*d* and 6*e* which is various views of piston 40. Piston 40 is a working member configured to be movable up and down cylinder 129 and inner walls 122 with little friction. Piston 40 has an appropriate hermetic sealing system using piston rings 47. Piston rings 47 can be circular metallic or non-metallic elements that ride in groove 46 of piston 40 and provide sealing between the freely movable piston 40 and the inside wall 122 of the cylinder 129. Piston rings can be made of leather, heat resistant foam rubber or other types of rubber and plastics resistant to heat and pressure sufficient for a particular application. Piston ring 47 could be a split ring that is disposed and configured to fit in one or more grooves 46 on the outer surface of piston 40. One aspect of groove 46 could be to hold piston 40 in place with a configured pusher assembly 180 while compressible fluid 140 is being squeezed by one or more weighted piston 40 or compressible fluid chambers 137 being pulled down by the force of gravity in cylinder 129. The purpose of piston ring 47 is to seal compression chamber 132 making it capable of substantial hermetic fluid isolation. Piston 40 could be solid or have a storage cavity 45 defining a storage area or container in which gravel and water or other matter could be disposed to permit appropriate weight adjustment. Piston 40 or container can be used interchangeably and can have the same functionality and be within the scope of the invention. Piston 40 could be free floating inside tank 160, or cylinder 129 and could be urged downward by the force of gravity or lowered down by a wire rope 62 attached to electromagnet 66 configured to attach to piston 40. Piston 40 is a working member that moves down inner walls 122 of cylinder 129 as it descends it makes smaller the volumes of fluid in fluid compression chamber 137, thereby compressing fluid into a higher psi. The outside periphery of piston 40 is capable of fluid isolation because of the pressure applied onto cylinder 129 inner walls 122 of air compressor 200 by the outer periphery of piston 40 or piston rings 47. Extending vertically from bottom 72 periphery fastened or molded is a cylindrically shaped wall 48 defining a cylindrical container which defines piston 40. The thickness of wall 48 could be relatively small in comparison to the height of wall 48. Inner wall 49 has a recessed an inside rim 71 that supports rim holes 44 that are in vertical alignment with lid 51, lid holes 43, and connector 42 that are along several intermediate stations around the center circumference of inside rim 71. Inside rim 71 has a smaller circumference than disposed lid 51 that is configured so all holes and connectors 42 are in alignment, fit securely, and is capable of fluid isolation. A resilient member, such as a gasket 76 or an o-ring, could be disposed onto inside rim 71 that lid 51 sets on, which further guarantees a fluid-tight seal when lid 51 is closed. A metal disc 41 could be flush with a lid top surface 73 and embedded centrally and firmly into lid 51. The front of piston 40 has a curvature matching the curvature of a cylindrical wall 48 with grooves 46 configured to support piston rings 47. Piston 40 is a working member which has relative sliding, sealing, and engagement with the encompassing inner wall 122 of cylinder 129 that is a working member like many other air compressors. Piston 40 is unique with many other air compressors in that it is without a connecting rod, or screw. Piston 40 is unique because it is disconnected, weighted, free floating and is forced down cylinder 129 inner walls 122 by gravity with the purpose of forming stacked compressible fluid chambers 137 while compressing compressible fluid 140 as defined herein to be released through outlet 118 to be used downstream or locally. Piston 40 can be solid or have a storage area for weight adjustment.

Storage cavity 45 can be configured to be a cooking area for foods or other matter and could be in the spirit of the invention. There can be more than one piston 40 forming one or more compression chambers 132 inside cylinder 129 of air compressor 200. Piston 40 also is novel because it is pushed by pusher 172 through piston transfer duct 80 into a liquid 30 where piston 40 is buoyant and floats upwards and is guided by first guide 125 and picked up by piston transporter assembly 50 and is transferred back to the top of air compressor 200 to complete a cycle of piston 40. Piston 40 is capable of recovery making it novel. Piston 40 is unique in that stacking and adjusting the weight of piston 40 can determine approximately the psi at any given point in cylinder 129 of air compressor 200 and dictates the materials that must be used in constructing air compressor 200 for safety and keeping within compressed air laws and regulations. The angle of air compressor 200 could vary when configured for a mountain slope. Piston 40 could fall or when configured in a sphere, piston 40 could roll through cylinder 129 and still be in the spirit of the invention. In a deep water, cliff, or mountain application stacking compressible fluid chambers 137 could be preferred and tank 160 could be used more like a pipe and could be a mile deep, long, or high with multiple compression chambers 132 and still be in the spirit of the invention. Piston 40 can take any shape needed in a particular application as long as it is capable of moving downward freely and with little friction within cylinder 129 in air compressor 200, and is capable of fluid isolation from each other and still be in the spirit of the present invention. Compression chamber 132 or fluid compression chamber 137 itself could vary greatly in length depending on the particular application and mass of compressible fluid 140 needed for a particular application. Air compressor 200 could be 100 feet or less in length and any circumference needed for a particular application, as mentioned before smaller diameter pipe is cheaper than larger pipe and may be used in multiples rather than one larger pipe and be within the scope of the invention. Air compressor 200 it is contemplated would be used most often at the lengths between 100 feet to 500 feet. For larger masses of compressible fluid or higher pressures, air compressor 200 could be 500 feet to 2500 feet in length and would be within the scope of the invention. Air compressor 200 could be 2500 feet to 5 miles or longer and be within the scope of the invention. The purpose for example could be to get more air mass into compression chamber 132 or fluid compression chamber 137 so that the ending higher pressured mass of compressible fluid 140 would be greater. Psi, temperature, or mass is only limited by the quantity or quality and strength of the materials available to make up air compressor 200. Piston 40 could be configured to be lowered, deposited, positioned, or dropped at preset timed intervals configured to form one or more air compression chambers 132 or compressible fluid chambers 137 capable of fluid isolation from each other. The timed preset intervals purpose herein is at least one to allow time for filling or loading ambient air into filling region 127, the space that is vacated as piston 40 is urged down cylinder 129, and allowing time for the compressing of atmospheric air or compressible fluid 140 in cylinder 129, compression chamber 132 or compressible fluid chambers 137, and to provide a smooth rotation of piston 40 through the system and all its embodiments. A wide variety of timing sequences for the lowering of piston 40 into cylinder 129 is inevitable due to the varied lengths of compression chambers 132 and the length of cylinder 129. A wide variety of timing sequences of the lowering of piston 40 into cylinder 129 is inevitable due to the wide variety of temperatures, psi and masses, desired for each and every particular application. One cylinder 129 application could have several compressible fluid outlets 118 to exit fluid at different temperatures or pressures which would facilitate even more possible timing sequences as would be obvious to someone skilled in the art. Solutions to the timing of the dropping or depositing of piston 40 would be obvious to someone skilled in the art using the well documented gas laws discussed herein. It should be obvious for safety, someone skilled in the art should build, maintain, and operate the embodiments and elements discussed herein. Piston 40 could be seated inside each cylinder 129 by several metal piston rings fitted around its outside surface in machined grooves; typically two or more for compression sealing. A piston 40 could be solid, or contain a centrally located storage cavity 45 having a function of adding weight or configured to cook in, with or without piston rings 47. The terms air, gas, compressible fluid 140, and fluid could be defined as having the same functionality and could be used interchangeably. Referring now to another aspect of FIG. 2 is an embodiment viewed on FIG. 11*a* that illustrates a piston transfer outlet 79 and FIG. 11*b* that illustrates piston transfer duct 80. The location of piston transfer outlet 79 or piston transfer duct 80 providing a piston 40 exit is most often opposite pusher assembly 180 near the lower portion of air compressor 200, but is not limited to that location. Piston transfer outlet 79 could be located below compressible fluid exit 118 where the compression chamber 132 empties into. Piston transfer outlet 79 or piston transfer duct 80 could be connected to a piston exit outlet 105 (see FIG. 2). Piston outlet 105 is defined herein as a piston exit both terms can be used interchangeably and can have the same function. Piston transfer outlet 79 or piston transfer duct 80 are defined as piston exits. Piston transfer outlet 79 could define a continuous single outlet with only one end connected or moulded to air compressor 200 and the opposite end an outlet for piston 40 to exit into liquid 30. The purpose of piston transfer 79 an 80 respectively is to transfer piston 40 from air compressor 200 into liquid 30 while each piston 40 is capable of fluid isolation from each other. Piston transfer duct 80 comprises an outer walls 83 defining a rectangular duct connected by a flanges 82 on each end with a connectors 81. One end of piston transfer duct 80 could be connected to piston exit outlet 105 of tank 160 and the opposite end could be connected to entrance inlet 70 on transfer tank 100. Piston transfer 79 and 80 has a larger inside circumference than the smaller circumference of piston 40 periphery so piston 40 can pass through central passageway 88 snugly and out a piston exit 61. Piston 40 is capable of fluid isolation from each other. An adhesive is used, natural or synthetic, that bonds safely and securely together an inner wall 84 and a pad 87 bringing them together as one unit. Pad 87 can be made of at least one but not limited to these examples, polyurethane foam, vulcanized rubber, nitrile rubber and synthetic fiber. The material should push in as piston 40 passes then regains its shape providing a pressure point 89 capable of fluid isolation. Pressure point 89 acts as a shut off valve for fluids as piston 40 passes through central passageway 88. A tubing 86 can be made of at least one but not limited to these examples, latex, elastomeric rubber, and polymers with viscoelasticity or other materials known to someone skilled in the art. The purpose of tubing 86 is to put pressure on all sides of piston 40 as it passes through central passageway 88 of piston transfer 79 and 80 giving even greater assurance piston transfer 79 and 80 is capable of fluid isolation. Tubing 86 is attached to pad 87 with a connectors 78 starting at one end and along several intermediate stations along pad 87 configured to allow piston 40 to create pressure points 89 and to allow piston 40 to be pushed through central passageway 88 smoothly and capable of fluid isolation as illustrated on FIGS. 11*a* and 11*b*. Tubing 86 may extend beyond pad 87 in length into transfer tank 100 or in liquid 30 and be within the scope of the invention as further illustrated on FIG. 11*a* and 11*b*. The main difference between both is piston transfer 79 is defined herein as one continuous outlet for piston 40 and piston transfer duct 80 attaches at opposite ends and deposits piston 40 into transfer tank 100. Both provide central passageway 88 capable of fluid isolation from air compressor 200 to liquid 30. Both have piston exit 61 located where the piston exits piston transfer 79 and 80. Multiple air compressor 200 can feed into one or more piston transfer 79 and 80. Piston transfer duct 80 could be connected to a set of two or more tanks, tubes, channels, or pipes forming a continuous duct, pipe, or tube with one or more inlets and outlets into each tank, liquid 30, tube, or pipe. One or more of Air compressor 200 could feed piston 40 into one or more Piston transfer duct 80 or piston transfer 79 which could feed into liquid 30 and be in the spirit of the invention. Piston transfer duct 80 or piston transfer 79 could be or include at least one or more of the following a conveyor, chute, slide, chamber, tube, compression chamber 132, outlet, or any other means capable of fluid isolation and obvious to someone skilled in the art to transfer piston 40 into liquid 30 or to another piston transporter. It is intended cylinder 129 could be extended in length. Piston 40 could be configured with one or more grooves on its outside periphery. One or more pusher assembly 180 could be configured with bushing 171 to protrude through wall 121 and protrude like a knob and find the groove or receiving hole in piston 40 and hold it in place until it is time to release piston 40 into liquid 30 at which time the PLC would activate the pusher in reverse and let go of the piston 40. Pusher assembly 180 could also hold piston 40 in place in the same way while compression is taking place in compressible fluid chambers 137 and then be released by pusher assembly 180 once fluid compression chamber 137 is emptied of compressible fluid 140. Pusher assembly 180 can be pneumatic, hydraulic or powered by electricity. The PLC connected to sensors and actuators could be timed by real time to actuate pusher assembly 180 to urge forward pusher 172 into a groove in the top portion of piston 40 holding it in place until a predetermined time then actuate pusher 180 causing pusher 172 to reverse releasing piston 40 into liquid 30 and shutting pusher assembly 180 off, the cycle then can be repeated again and again as programmed in the PLC storage. Pusher 172 could be attached to a platform at its distal end and be configured to press against wall 121 where wall 121 could be semi flexible to allow pusher 172 to be configured to hold one or more piston 40 in place by applying pressure against wall 121 and piston 40 until it is time according to the PLC to release piston 40 at a predetermined time. Pusher assembly 180 can be configured to hold piston 40 in place to give stability to piston 40 while the fluid compression chamber 137 above is discharging its compressible fluid 140 through compressible fluid exit 118 and into air flow duct 190 each having fluid communication with each other. Pusher assembly 180 can be configured to hold piston 40 in place to give stability to piston 40 until at a predetermined time it releases it to exit and piston transporter assembly 180 grabs it or piston 40 is released into liquid 30. Piston transporter assembly 50 can be configured to grab piston 40 and take it to opening 124 as discussed in at least one cycle 1, 5, 6, and 7 above herein. Cylinder 129 can be configured vertically with a horizontal lower portion like an "L", or a lower portion at an angle with a slow bending curve, none, all or part coiled. Cylinder 129 could be configured like a hook (J) or a (U) with a slow bending curve. The force downward of the contents in the compression side of cylinder 129 could be offset by the force on the piston exit side of cylinder 129 or piston 40 could be held in place by pusher 180 until it is time to be released into liquid 30 or to transporter 50. Cylinder 129 can be larger than piston 40 on the top portion of cylinder 129 exit side. Cylinder 129 could be configured in part or all, on the exit side, as that of piston transfer outlet 79. Possibly any configuration obvious to someone skilled in the art that would allow one end fed by the transfer device to have a greater downward force of gravity at least the weight of one piston 40 and it must have piston 40 totally free from being impeded in any way to move up and down by the force of gravity on the compression side. One example would be that of a water level the fluid must be unimpeded totally to seek level. This would work like a water level taking advantage of the basic physics fact water always seeks its own level. Piston 40 and the contents in cylinder 129 could be configured to be capable to function like a water level. It could have the end fed by the transfer device have a substantially greater downward force of gravity and must have piston 40 totally free from being impeded in any way to move up and down by the force of gravity on the outlet side. If this is accomplished piston 40 can be deposited in a liquid 30 to cycle to the top of cylinder 129 and be deposited into cylinder 129 starting a complete cycle all over again.

Referring to another aspect of an embodiment as seen on FIG. 3 of air compressor 200. One advantage of air compressor 200 is it can be configured to function in or out of water. Air compressor 200 used as a heat source is a fundamental enjoyed. Many if not all other compressors heat is a negative factor. Vertically positioned air compressor 200 sets on foundation 22. Foundation 22 is configured to be capable of holding air compressor 200 weight safely. Anything known by someone skilled in the art that will stay strong, rigid, and level could be used as foundation 22 such as solid rock, concrete, packed ground, or ice that stays solid year around and would support air compressor 200 weight safely. Connected to outside wall 120 and foundation 22 is bracket 142 and connector 141 at separate intervals as needed, to provide a rigid stable supporting of vertical air compressor 200. Air compressor 200 has at least one or more of the following condensation nozzle 106, compressible fluid exit 118, piston exit outlet 105, and gauge and valve outlet 150 for valves, gauges, and other measuring and monitoring devices. Liquid filter 102 and one-way check valve 104 are fastened to or inside the periphery of nozzle 106 that is located at the lowest point of wall 121 configured to purge water and sediment. Air compressor 200 could have a condensation cavity 110 located below platform 107 with a hole 108 configured for condensation and sludge to fall through. On each opposite side of air compressor 200 above platform 107 are piston exit outlet 105 and pusher outlet 115. Piston transfer outlet 79 or piston transfer duct 80 could be connected to piston exit outlet 105. Piston transfer outlet 79 and piston exit outlet 105 could be a single moulded outlet or connected as one continuous outlet with a central passageway 88 for piston 40 to pass through and into liquid 30. Passageway 88 could be a piston exit. Cycle 4 is where fluid compression chamber 137 have been spent and only piston 40 remain stacked and inside cylinder 129 below compressible fluid exit 118 ready for pusher assembly 180. Piston 40 actuates a limit switch that activates and starts drive motor 179 forward causing a transmission 170 and gears to rotate forward causing a pusher 172 with teeth to urge straight forward advancing Alpha piston 40 into a straight horizontal contiguous formation of piston 40 passing piston 40 already in a piston transfer duct 80 straight forward through central passageway 88 of piston transfer duct 80 causing omega piston 40 to pass through and exit into the inside base of transfer tank 100 filled with liquid 30. Inside transfer tank 100 piston 40 actuates a limit switch that activates motor 179 causing it to power on in reverse causing transmission 170 and gears to rotate in reverse causing pusher 172 to urge straight backward to its original position where a limit switch actuates and deactivates motor 179 to stop ready for the next cycle. Piston 40 diameter is smaller than the larger inside diameter transfer tank 100. Pusher outlet 115 has bushing 171 with pusher 172 passing through the center. Pusher outlet 115, bushing 171, pusher housing 176, and cylinder 129 are all capable of fluid isolation. Smaller compressible fluid exit 118 passes through cylinder 129 and extends outward past wall 121 with suitable room for larger air flow duct 190 to make a fluid tight firm connection. Compressible fluid exit 118 has a smaller diameter than the larger diameter of air flow duct 190. Cylinder 129 has gauge and valve outlet 150 accessibly located, for valves, gauges, and other measuring and monitoring devices. Cylinder 129 could be between 30 degrees and 150 degrees configured to allow piston 40 to move down cylinder 129 by the force of gravity, to compress air 130 as piston 40 moves down inner wall 122 of cylinder 129 containing one or more fluid compression chamber 137, configured to compress air 130, and capable of fluid isolation from each other. Cylinder 129 with more than one fluid compression chamber 137 could compress more than one compressible material at a time. Multiple compressible fluid chambers 137 in cylinder 129 could each have possibly a different psi or contents. Heat under pressure could be produced using air compressor 200. Heat and pressure are fundamental to air compressor 200. It is a fundamental fact air heats up while being compressed. Compressible fluid exit 118 contains flow control valve 114 and one-way check valve 116 connected by means of a pipe, or disposed and attached to the inside periphery of compressible fluid exit 118. Compressible fluid exit 118 with flow control valve 114 to control the flow of compressible fluid 140 provides fluid communication between compressible fluid 140 in fluid compression chamber 137 and air flow duct 190. Positioned and configured on wall 121 located to be accessible is gauge and valve outlet 150 that can be male or female and can have air flow valve 152 and one-way check valve 154 connected by means of a pipe, or disposed and attached to the inside periphery of gauge and valve outlet 150. Tank 160 has wall 121 with outside wall 120 and inner wall 122. Cylinder 129 could contain at least one or more of the following piston 40, compressed air 130, filling region 127, compression chamber 132, compressible fluid 140, an ambient air 123, elongated hollow tube 136, or fluid compression chamber 137. Located at the top of cylinder 129 or tank 160 is opening 124, which can be at least one the air entrance and the piston entrance, which is larger in diameter than a smaller in diameter piston 40. The air entrance, opening 124, can be an inlet smaller than piston 40 and their can be another one or more opening 124 for the entrance of piston 40 such as a side entrance entering cylinder 129. Their can be a plurality of opening 124 located in cylinder 129 of different sizes for the purpose of at least one ambient air 123, fluid and piston 40 being introduced into cylinder 129. Located at the top of cylinder 129 or tank 160 is a second guide 126 disposed at separate intervals around the periphery of opening 124 with the purpose of guiding piston 40 into position to be deposited into cylinder 129 at preset timed intervals accomplished by piston transporter assembly 50 and a PLC discussed herein (see FIG. 9). Horizontal frame member 58 on one side is connected to vertical beam frame member 59 fastened firmly to and resting on the top of mount 128 fastened to the top side of tank 160 on its opposite side beam frame member 52 is fastened to and resting on the top of mount 134 or mount 37 attached to reservoir wall 169 or an outside wall 32 respectively (see FIG. 2 for a view of the above explanation). The embodiment on FIG. 3 could operate submerged in liquid 30 or it could operate out of water and still be in the spirit of this invention. FIG. 2 uses some type of containment for liquid 30 such as reservoir 131. FIG. 3 could use a body of liquid 30 such as a lake, ocean or sea to recover piston 40. The embodiment shown in FIG. 3 can operate out of water such as upright on a foundation 22 or on the side of a mountain or cliff. Air compressor 200 could work well on many configurations of a surface and its environment as long as gravity could force piston 40 downward, even any angle air compressor 200 sets on could work such as down a mountainside as long as the pull of gravity is strong enough to force piston 40 down cylinder 129. Air compressor 200 could be a plurality of air compressor 200 as working members such as seen on FIG. 4*a* and FIG. 4*b*. A programmable logic controller (PLC) as defined and discussed herein could be a preferred means for automation of electromechanical processes, such as controlling, operating, and actuating embodiments and elements shown on FIG. 3 on run time. The system or air compressor 200 as discussed herein can provide a source of motive power to air compressor 200, all its embodiments, elements, and the PLC. The PLC operates piston transporter assembly 50 causing it to lower and deposit piston 40 into cylinder 129. Ambient air at a higher pressure rapidly flows down through opening 124 and is sucked down into cylinder 129 relieving the low pressure area of low pressure air caused by piston 40 moving down cylinder 129 while capable of fluid isolation. When piston 40 reaches equilibrium or at a predetermined time the PLC actuates causing electromagnet 66 to release and deposit piston 40 into cylinder 129. The PLC actuates again causing forward movement of motor 74 to stop. The PLC actuates again causing motor 74 to reverse rolling up wire rope 62. The PLC actuates again causing and motor 74 to stop at a preset time. Hoist 55 is given motive force by motor 74 to move forward to a preset position and stops over the center of piston 40 at a predetermined time. Hoist 55 again is given motive force to motor 74 causing drum 53 to urge forward until it finds piston 40 or at a predetermined time. The PLC actuates again causing electromagnet 66 to turn on grabbing piston 40 and the PLC actuates again causing drum 53 to reverse rolling up wire rope 62. Near the top the PLC actuates again causing the reverse of drum 53 to stop. The PLC actuates again causing hoist 55 to move forward to air compressor 200, and opening 124. The PLC actuates again causing Hoist 55 to stop its forward motion. The PLC actuates again causing piston 40 to move downward into cylinder 129 and at a predetermined time stops forward motion and releases and deposits piston 40 into cylinder 129. The PLC is actuated again rolling up wire rope 62 and the PLC actuates again and causes motor 74 to stop at the top of cylinder 129. This continues as described herein until air compressor 200 is primed and at base state. Flow control valve 278 and 114 respectively is opened to control compressed air 130 that is channeled and contained within air flow duct 190 that flows rapidly into tank 300 or a turbine downstream smashing into the blades with significant force to cause rotation turning a shaft of a turbine converting mechanical rotation into electrical power or fills a cave with compressed air 130 for use at a power plant. With multiple air compressor 200 flowing through air flow duct 190 like a wind tunnel their may not be a need for storing compressed air 130 in a cave. Air compressor 200 could handle the power plants needs directly. With massive amounts of steam, wet steam, saturated (dry) steam, superheated steam or supercritical water available as illustrated on FIG. 17 a power plants needs for steam or supercritical water could be handled directly. In a turbine moving fluid acts on the blades so that they move and impart rotational energy to the rotor. A turbine can be directly connected to an electric generator for the generation of electric power for air compressor 200. Often applications now use reduction gears or an intermediate electrical step, where the turbine is used to generate electricity, which then powers an electric motor connected to the mechanical load that would be in the spirit of the invention. This gives a source of motive power to piston transporter assembly 50 and pusher assembly 180 discussed herein previously. Air compressor 200 sets on a foundation 22. It is important there be at least one or more preferably a plurality of compression chambers 132 in cylinder 129. It would be common sense to someone skilled in the art if piston 40 is configured to only allow sufficient pressure build up for a particular application such as a blower or you adjusted the flow control valve configured to function like a blower that you could have bellows or a blower which is another aspect of the present invention and would be in the spirit of the present invention. It would be obvious to someone skilled in the art wind turbines creating energy could enjoy large volumes of air flow (wind) created by multiple properly timed and configured air compressor 200 that could create large volumes of hurricane force winds in air flow duct 190 configured to be a wind tunnel and that would be in the spirit and scope of the present invention. Therefore, configuring the timing of the lowering of piston 40, its weight, size, and distance of drop are all important to getting and maintaining proper psi, temperature, and mass of compressed air 130 needed for a particular applications functionality. Compressible fluid exit 118 and air flow duct 190 can be placed anywhere along wall 121. They preferably should be placed at the lower part of the compression chamber 132 that has the desired psi, temperature, or mass of fluid. Some materials that could be used in the system and its embodiments are several types of materials approved for natural gas work including those used for transporting natural gas long distances underground. The codes for the local jurisdiction should always be checked but overall, a strong carbon steel material, engineered to meet standards set by the American Petroleum Institute (API) can handle 200-1500 psi. These pipes can be strapped to give greater strength. These pipes can be up to 43 inches in diameter. In contrast, some of these types of pipe are made of highly advanced plastic, because of the need for flexibility, versatility, and the ease of replacement. Approved materials for gas pipes include steel, copper, yellow brass, ductile iron, aluminum, PE, highly advanced plastics, and concrete, but other materials could work also. Someone skilled in the art should choose the particular pipe for a particular application. In a strong carbon steel pipe schedules 40 and 80 cover the full range from 15 mm up to 600 mm of sizes and is the most commonly used schedule for gas pipe installations. API carries many up to date regulations. Local, State, Federal and International regulations and laws must also be followed for safety. The heretofore mentioned materials could be the preferred materials used in the present invention, but other materials known by someone skilled in the art, would work also. Some applications require low pressure (100 psi) and low heat build up. Cold and excess pressure can cause some plastics such as PVC to burst sending shrapnel everywhere so it is important only someone skilled in the art build, operate and maintain the embodiments and all their elements herein. Some advantages of this type of air compressor include on-site smooth, pulse-free gas output with high output volume. It can be started and maintained on-site without an outside source of off-site electricity. Once primed just open the valves and the on-site generator will keep it going with low maintenance. Air compressor 200 can be configured to run off of compressed air 130. It can be configured to produce heat, compressed air, hot air, cold air, steam of various types and supercritical water. Heat can be used in cold climates to heat buildings and keep this unit from freezing up. Cold, wet, or hot weather does not adversely affect air compressor 200. Wind machines can be affected by ice build up or no wind, solar by a lack of sun. compressed air 130 exerts an expansive force that can be used as a source of power to operate machinery and pneumatic tools. Because the turbine generates rotary motion, it is particularly suited to be used to drive an electrical generator such as a steam turbine. One embodiment of air compressor 200 used as a heat source can make steam.

Figure 7:
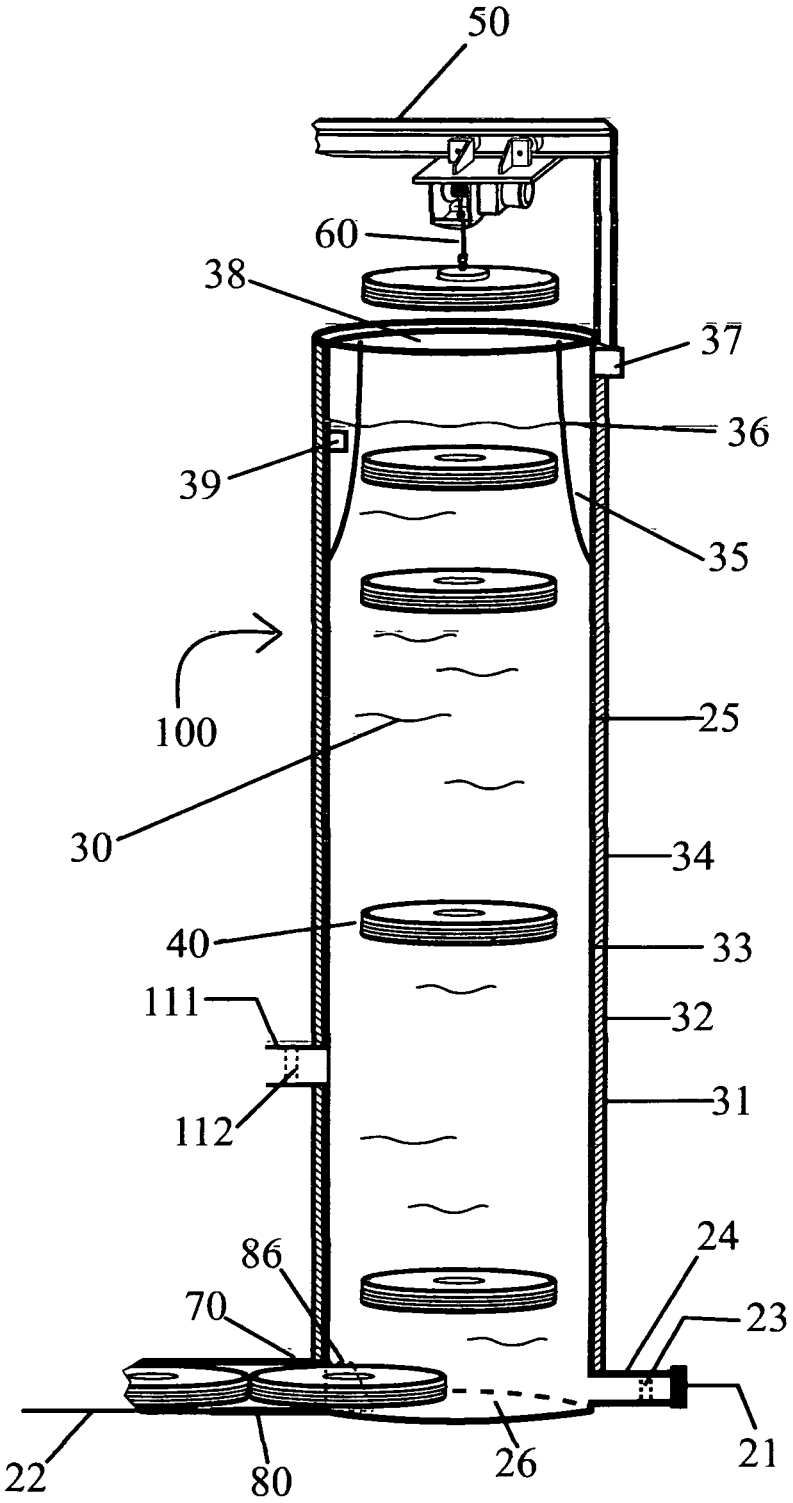
FIG. 7 shows a view of a transfer tank.

Referring to another aspect of an embodiment as seen on FIG. 7 transfer tank 100. Transfer tank 100 defines cylindrical a tank 31 filled to near the top with liquid 30. Vertically positioned transfer tank 100 sets on foundation 22. Foundation 22 is configured to be capable of holding transfer tank 100 weight safely. Extending upwardly from a bottom 26 periphery is a cylindrically shaped a wall 33 defining an elongated hollow body 25 which defines tank 31 without a top. The top portion of tank 31 forms an opening 38 for extracting piston 40. The purpose of transfer tank 100 is to provide a means for transporting piston 40 from the base of tank 100 upward to the top of tank 100 by means of buoyancy. Potential energy change device and transfer tank 100 are defined as synonymous and may be used interchangeably. Transfer tank 100 is a potential energy change device filled with liquid 30 having density greater than air to enable piston 40 having a density smaller than the density of liquid 30 to gain potential energy from the density difference between liquid 30 and piston 40. The potential energy change device could also be a piston transporter. Piston 40 is less dense than liquid 30. Tank 100 being filled with liquid 30 and piston 40 being buoyant. Piston 40 being disposed into transfer tank 100 by means of transfer duct 80 is pushed through and to the inside of transfer tank 100 by means of pusher 172 as discussed in detail within FIG. 11*b*. Piston 40 is buoyant and rises to the top of transfer tank 100 where piston transporter assembly 50 and electromagnet assembly 60 transports piston 40 to the top of air compressor 200 to start the cycle over again as described in detail within FIGS. 6*a*, 6*b*, 6*c*, 6*d* and 6*e* and at least one of cycles 1, 5, 6, and 7 discussed herein. Tank 31 has one or more inlets, outlets, ports, nozzles, and spouts. Cap 21 caps a water fill outlet, nozzle 24. Fastened to or inside the periphery of nozzle 24 is an open and closed valve 23. Nozzle 24 is located at the lowest point of wall 33 configured to purge water and sediment. Nozzle 24 can be connected to a source of water to fill tank 100. Nozzle 24 could be connected to a pipe, hose, tube or a condensation tank assembly 90. Mount 37 is connected to an outside wall 32 of transfer tank 100. Piston transporter assembly 50 rest on the top of and is connected to mount 37 and the opposite end of piston transporter assembly 50 is connected to mount 128 connected to outside wall 120 of air compressor 200. Piston transporter assembly 50 sets level, horizontal, above and across air compressor 200 and transfer tank 100. Piston transporter assembly 50 is connected to electromagnet assembly 60. Transfer tank 100 has a float valve 39 fastened to inner wall 34 just below a water line 36 for the purpose of stopping and starting the flow of water to tank 31 as it reaches a predetermined point. Tank 31 is filled to near the top with liquid 30. Transfer tank 100 could have one or more outlets for valves, meters, gauges, and other measuring and monitoring devices. Monitoring outlet 111 can be controlled with on and off valve 112 that could be fitted with an actuator as could any valve herein. Piston transfer duct 80 is connected to piston exit outlet 105 protruding through wall 121 of air compressor 200. The opposite end of piston transfer duct 80 is connected to an entrance inlet 70 of transfer tank 100. Piston 40 is smaller but presses the inside of larger passageway 88 sufficiently to make each piston inside passageway 88 capable of fluid isolation inside piston transfer duct 80. Tubing 86 may extend beyond pad 87 in length into transfer tank 100 as further illustrated on FIGS. 11*a* and 11*b*. Piston 40 is disposed horizontally on platform 107. Piston 40 is pushed forward pushing through piston transfer duct 80 by pusher 172 that is given motive force by motor 179 and transmission 170. When piston transfer duct 80 is filled end to end with piston 40 the last piston 40 in line is pushed through piston transfer duct 80 and into liquid 30. Piston 40 is configured to be buoyant that allows it to rise up inside transfer tank 100 guided by a second guide 35 and caught by electromagnet 66 a part of piston transporter assembly 50 and is taken to air compressor 200 positioned and deposited into cylinder 129 to start the cycle over as discussed in detail and illustrated on FIG. 11*b* and FIG. 3 and discussed in detail in at least one of cycle 1, 5, 6, and 7 herein. Piston 40 with slideability is sufficiently weighted to move down an elongated hollow tube 136, by the force of gravity, and is configured to be capable of compressing air.

Referring now to another aspect as seen on FIG. 17, air compressor 200 is configured with tubing wrapped around or with at least one of layered tubing, vessel platforms, vessels, layered vessels, containing fluid and enjoying the heat from air compressor 200.

FIG. 17 is air compressor 200 as discussed herein previously with additional elements taking advantage of air compressor 200 being a source of heat. Another aspect of air compressor 200 is where it is additionally configured with wrapped tubing 162 around and about the exterior of air compressor 200. It could also be in the form of layered tubing, vessel platforms, vessels, layered vessels, and could have entrance fitting 163 for the entrance and connection of a source of fluid and an exit outlet fitting 161 for a fluid exit and connection to a tube or pipe (not shown) for the purpose of creating hot fluid, steam, superheated steam or saturated (dry) steam to be used downstream or locally. There is a series of fasteners 165, such as strapping fasteners, and connectors 164 connected securely to outer wall 120 and wrapping around tubing 162, starting at one end and along several intermediate stations securing the tubing 162 to the outer wall 162. For example circulated water could be heated by air compressor 200 while passing through tubing 162 and converted into steam for use locally or downstream. A wide mouthed outlet could be placed on the side of air compressor 200 anywhere it could be enjoyed and be configured with a fitting to connect a plurality of smaller tubing 162 to enable the heat from air compressor 200 to be used locally or transferred downstream and be within the scope of the invention. One or more tubing 162 can be wrapped around and about air compressor 200. It is not intended to just be wrapped around air compressor 200 it can be bent, twisted, coiled in any direction enjoyed by someone skilled in the art to take full advantage of heat and pressure generated by air compressor 200. This source of heat and pressure could be configured to enable the generation of steam, wet steam, saturated (dry) steam, superheated steam or Supercritical water. Heat and pressure generated by air compressor 200 with the use of tube 162 and vessels or plates could be configured to function as a boiler, superheater, hot water heater, or a heated pressure container with tubing 162 where the pressure container is or is not capable of fluid isolation with controlled inlets or outlets for fluids to enter and exit respectively. A configuration can be used with air compressor 200 that utilizes a bed or rows of tubing 162 or various shaped and configured vessels to heat circulated liquid 30, such as water for the purpose of converting it to useful steam or supercritical water. Large numbers of small diameter tubes leading to convective or radiant heat transfer can be used. The heated or vaporized fluid exits for use in various processes or heating applications, including boiler-based power generation, cooking, and sanitation. Air compressor 200 could be viewed as a long hot rod where the outer wall 120 or air compressor 200 is the heat source. A hot rod that can be configured vertically, vertically with a horizontal lower portion like an "L", at an angle with a slow bending curve, either all or part coiled, or configured like a hook (J) with a slow bending curve. Possibly any configuration known by someone skilled in the art that would allow one end fed by the transfer device to have a substantially greater downward force of gravity and must have piston 40 totally free from being impeded in any way to move up and down by the force of gravity. An example would be that of a water level the fluid must be unimpeded totally to seek a level one each side of the hose when shape like a "U". This would work like a water level taking advantage of the basic physics fact water always seeks its own level. Piston 40 and the contents in cylinder 129 must be capable to function like a water level only one end fed by the transfer device to have a substantially greater downward force of gravity and must have piston 40 totally free from being impeded in any way to move up and down by the force of gravity. If this is accomplished piston 40 can be deposited in a liquid 30 and follow the cycles discussed herein to cycle to the top of cylinder 129 and be deposited into cylinder 129 to start a cycle over again. The number of piston 40 in cylinder 129 forming fluid compression chamber 137 is only limited by the length of air compressor 200 and the materials it is made of to be capable of functioning safely. Air compressor 200 could be viewed as a long rod configured to have substantial heat to be used as someone skilled in the art has obvious need. Compressor 200 could be placed in water for hot water or steam for use locally to keep air compressor 200 warm in cold weather. Air compressor 200 could be placed in a container of liquid 30 such as water capable of fluid isolation for the purpose of cooking, boiling, creating pressure build up or contained heat with a release valve in the top portion or container with an entrance and exit, steam could be produced and used downstream in factories or power plants. Air compressor 200 could be configured so steam hits against the hot outside wall 120 or tube 162. Air compressor 200 could be placed above or below ground. Air compressor 200 could be placed in water contained or not contained depending on the particular needs of a particular application. One application could be configured as a boiler. This type of boiler comprises of a shell, a large pressure vessel, with a bundle of tubes inside it. One fluid runs through the tubes, and another fluid flows over the tubes, through the shell, to transfer heat between the two fluids. Superheated steam boilers vaporize the water and then further heat the steam in a superheater. Air compressor 200 could be configured to function as a superheater. Supercritical steam generators operate at supercritical pressure. One or more air compressor 200 could be configured to function as a supercritical steam generator. Sets of air compressor 200 can work together as working members, such as one set in liquid 30 and one set out of liquid 30. One set to generate steam another set to brush it against the hot walls and if needed another to increase the temperature or pressure of the steam. Heat, steam and pressure are fundamental to air compressor 200 as illustrated on FIG. 17. When a gas is compressed, work is done on the gas molecules. That means that additional energy is transferred to the gas molecules from piston 40. It is the additional energy that increases the kinetic energy (KE) of the molecules. Since temperature is directly proportional to the KE of the molecules, the increase in KE means the temperature goes up. If water is heated beyond the boiling point, it vaporizes into steam, or water in the gaseous state. Steam traps, pressure valves, air traps, bypass valves, or check valves can be placed by someone skilled in the art any where obvious placement would have benefit, and would be within the spirit of the invention. Compressible fluid chambers 137 could contain a variety of compressible fluid 140 as defined herein. For example fluid compression chamber 137 could be compressing air inside while another is taking advantage of heat and creating steam within another fluid compression chamber 137 filled with water and can be within the scope of the invention. Fluid can be introduced through an outlet anywhere it can be enjoyed on air compressor 200 or into cylinder 129 from opening 124 and be within the scope of the invention. Compressor 200 could be configured to be one or more hot rods to be placed into liquid 30 for the generation of steam, wet steam, saturated (dry) steam, superheated steam or Supercritical water. Compressing air 130 in compressor 200 can generate heat. Many boilers use combustion as a heat source. This heat source doesn't require fuels, such as wood, coal, oil, or natural gas. The air itself as it is compressed gives off a source of (green) heat. In a water tube boiler, boiler feed water flows through the tubes and enters the boiler drum. The circulated water is heated and converted into steam at the vapor space in the drum. This type of configuration would be in the scope of the present invention. A fluidized bed boiler using the heat source from compressing air 130 instead of a combustion source of heat would be in the scope of the present invention. The tubing illustrated on FIG. 17 could be configured to heat a bed of particles such as sand or it could have fluid (water) past through the tubes and the heat source could cause the water to form water vapor or steam. The working fluid steam, can be converted into mechanical work by steam engines and steam turbines. Electricity is most often generated at a power station by electromechanical generators, primarily driven by heat engines fueled by chemical combustion or nuclear fission. Air compressor 200 offers a source of heat. Air compressor 200 also offers compressed air along with a source of heat. Compressed air itself offers many advantages in generating electricity. Currently energy generated during periods of low energy demand (off-peak) can be released to meet higher demand (peak load) periods. Compressed air can be stored in caves, with air compressor 200 as mentioned herein it would not be necessary to store compressed air as air compressor 200 can be configured to make enough compressed air to be used by a power station directly. Any of these formations of air compressor 200, its embodiments or elements can be mixed or matched so one skilled in the art would obviously achieve greatest benefit from them, and be within the scope of this invention.

Figure 4A:
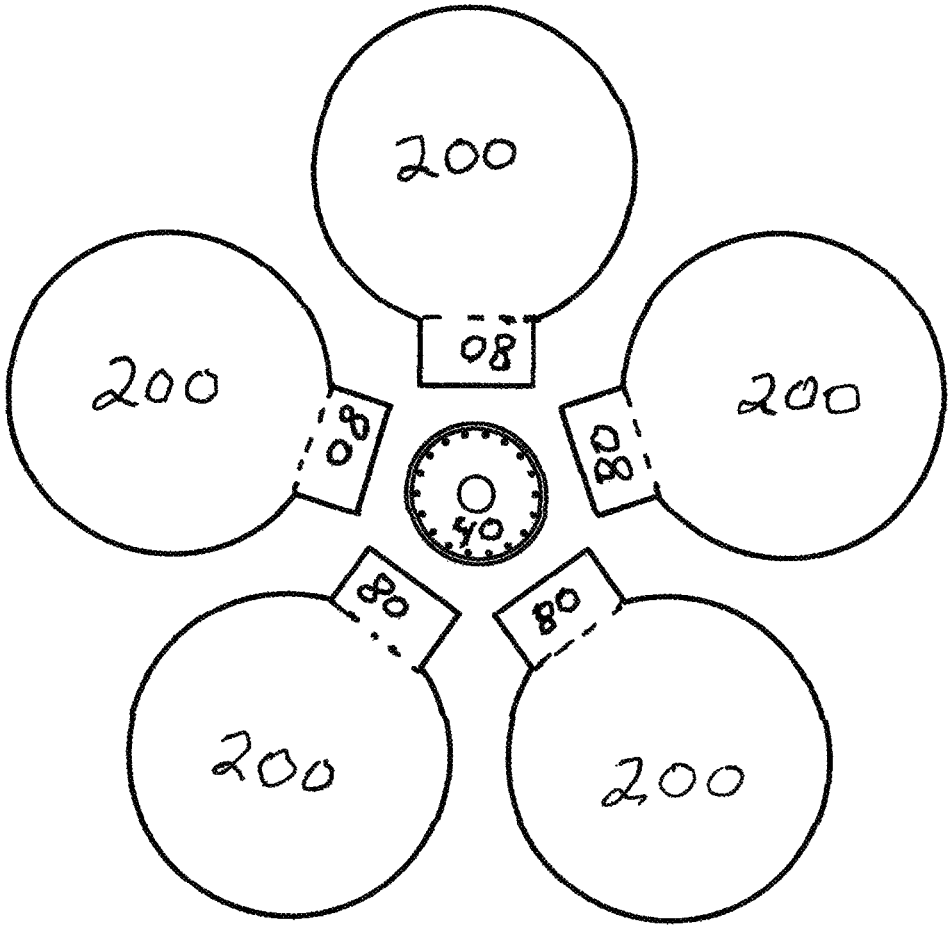
FIG. 4*a* shows a bottom schematic overhead view of a plurality of air compressors as working members.
Figure 4B:
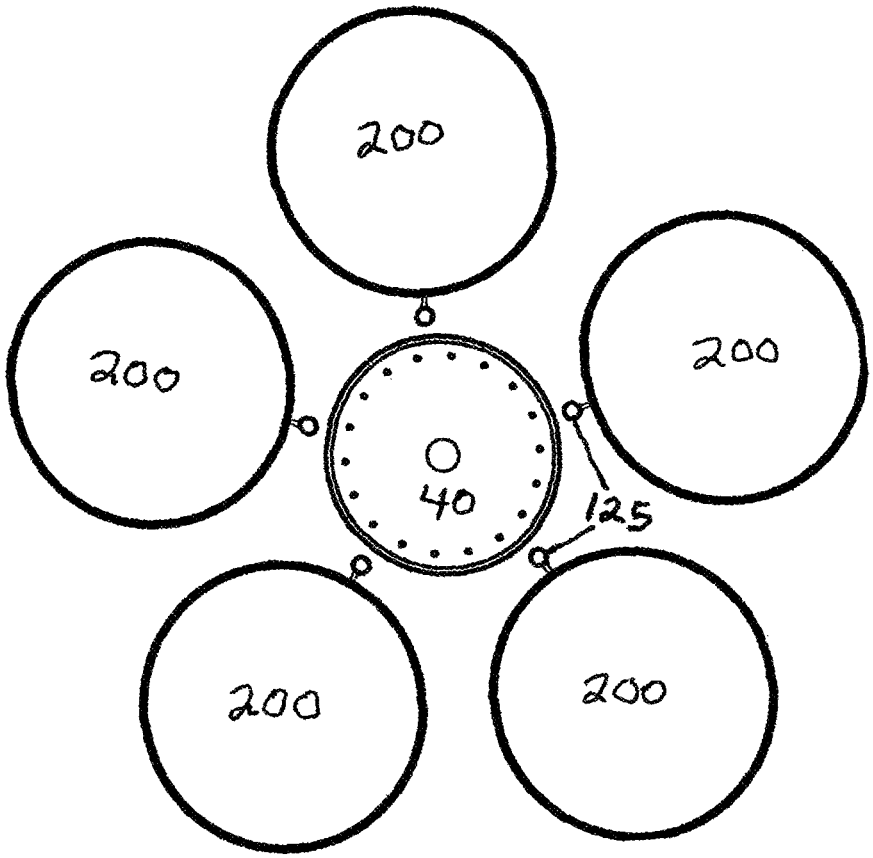
FIG. 4*b* shows a top schematic overhead view of a plurality of air compressors as working

Referring to another aspect of an embodiment as seen on FIG. 4*a* and FIG. 4*b* is a view of a plurality of air compressor 200 as working members. The center area is filled with liquid 30 such as water. piston 40 rises from the lower portion to the top portion without obstruction and could be guided by first guide 125 into place readied for a piston transporter assembly 50 to transfer it to the top of air compressor 200 and deposit it into cylinder 129, starting the cycle over again. They can be configured to work together in line, around a circumference, side by side or in any formation known to someone skilled in the art. This configuration works with at least three or more of each of FIG. 2, FIG. 3, or FIG. 17. FIG. 17 could have at least one or more pipe, tubing, flat water vessels stacked, tubing and vessels functioning together as working members, side by side, bundled or wrapped around and about outer wall 120 of air compressor 200 is in the spirit of the present invention. A plurality of air compressor 200 as working members with a source of heat configured as mentioned above could function as a boiler above ground, below ground or both above and below ground. The center area containing liquid 30 could be water, hot water, fluid, or steam. The center area containing liquid 30 could have pipe, tubing, tubing in layers, flat water vessels stacked or side by side, bundled containing fluid taking advantage of a plurality of air compressor 200 as working members with a source of heat to be enjoyed. The center area or all the fluid area could function as a large cooking vessel taking advantage of a plurality of air compressor 200 as working members with a source of heat to be enjoyed.

FIG. 2, FIG. 3 and FIG. 17 can be submerged in a liquid 30. FIG. 3, and FIG. 17 can be used out of liquid 30, such as on dry land. The purpose of the formation is at least one, to increase the mass of compressed air 130 available, eliminate the need for tank 100, provide a large vessel of hot liquid, and provide a large source of heat taking advantage of a plurality of air compressor 200 as a source of heat. A rotating piston transfer device that is set up for predetermined timed intervals from the potential energy device to air compressor 200 could be used to gather from transfer tank 100 and deliver piston 40 to at least one air compressor 200, a plurality of air compressor 200 and be deposited into cylinder 129. A conveyor, hoist, lifting medium, moving medium or slide could be configured and enable piston 40 to be transferred or transported and deposited into to the inside of cylinder 129 of air compressor 200 with any formation of the embodiments and be within the scope of the invention. The system or air compressor 200 provides a source of motive power locally or downstream. The systems motors being activated by the PLC provides a source of motive force for all embodiments. In a deep water embodiment the platform used as support could be fixed to the ocean floor with line such as wire rope, or it could comprise of an artificial island, raft, or it could float. The present embodiment could be configured such that a fishery out at sea could enjoy steam, electricity, compressed air 130, cold air, a blower for use with machinery and power tools.

Figure 5:
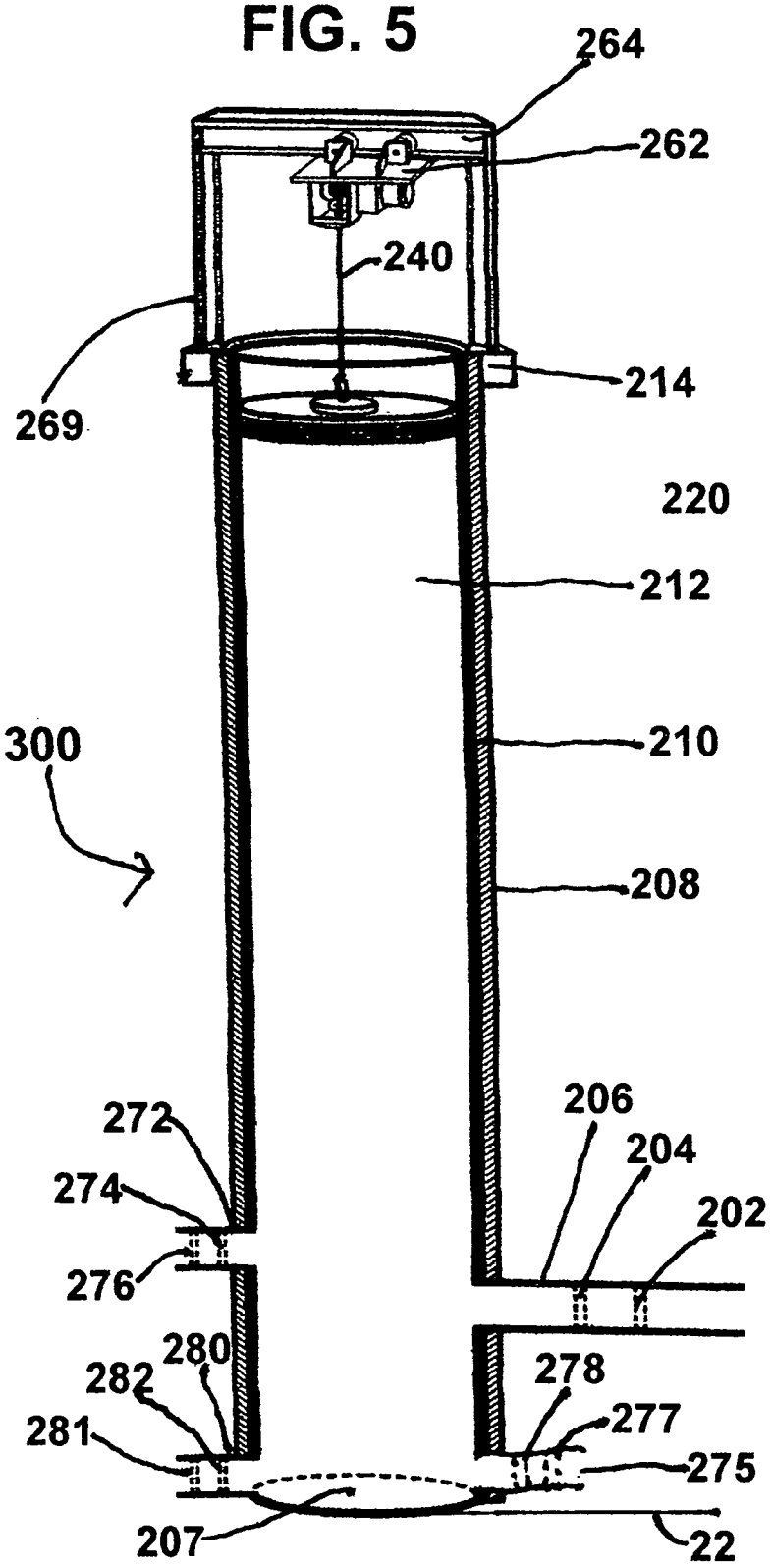
FIG. 5 shows a view of air receiver tank.
Figure 6A:
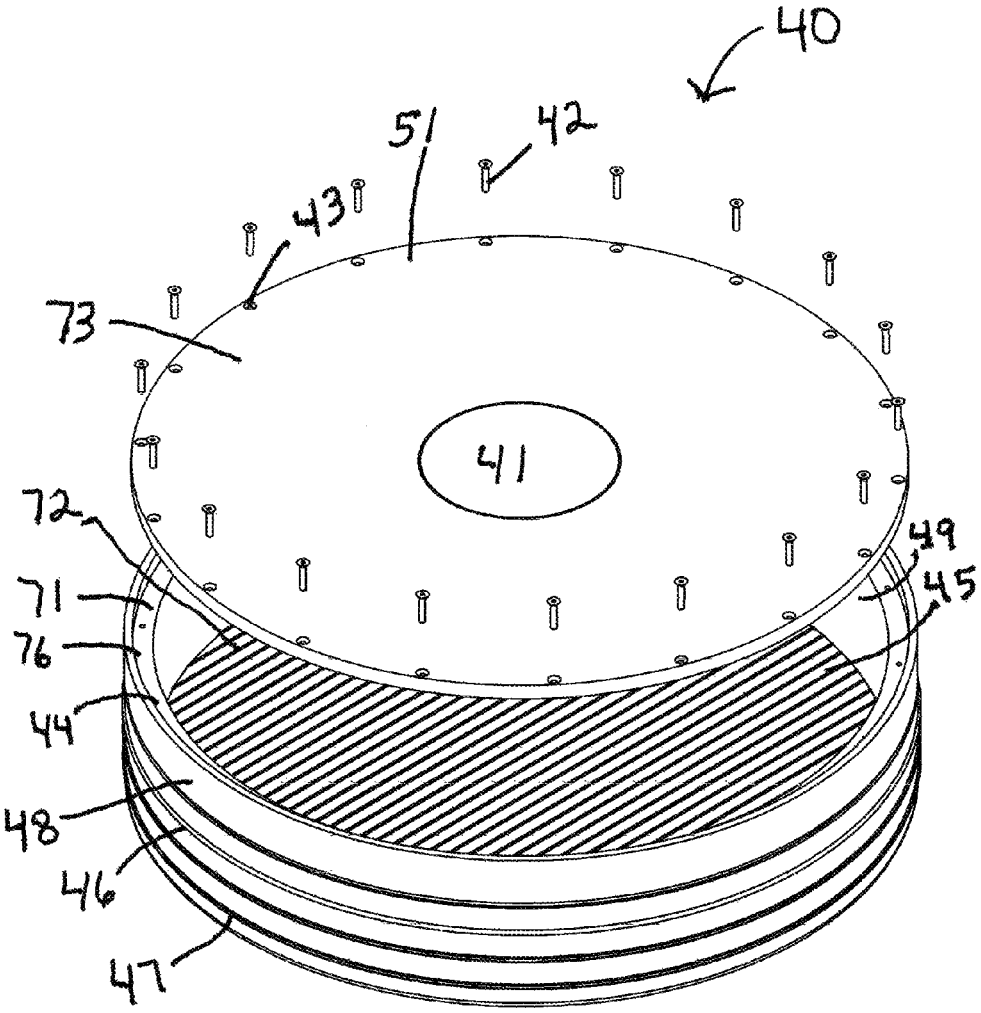
FIG. 6*a* shows an overhead angled view of a container piston with the lid open exposing a storage area.
Figure 6B:
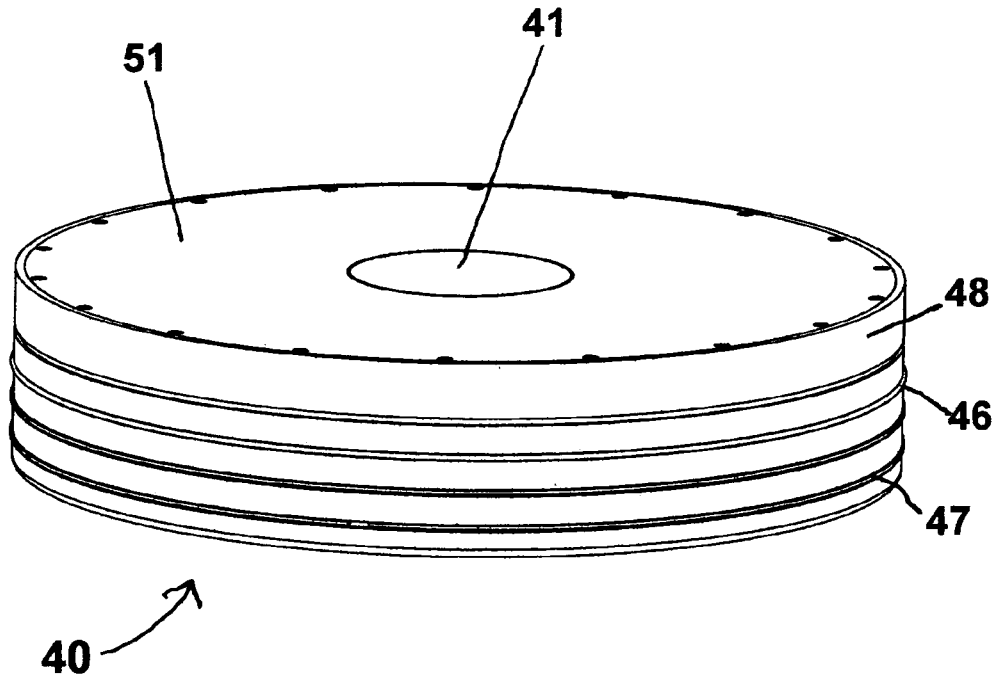
FIG. 6*b* shows an overhead view of a piston.

Now referring to another aspect as seen on FIG. 5 that defines air receiver tank 300 that sets disposed on foundation 22. Air receiver tank 300, with bottom 207 and vertical walls defines a cylindrical tank with an open top and condensation nozzle 275 at its lowest point. Inside or attached to nozzle 275 is flow control valve 278 along with one-way check valve 277. The purpose of nozzle 275 is to give access for removing sludge or condensation from air receiver tank 300.

Positioned and configured to be accessible is valve outlet 272 that can be male or female and has a pressure regulator 276 and an one-way check valve 274 connected by means of a pipe, or disposed and attached to the inside periphery of gauge and valve outlet 272. Air receiver tank 300 has an inlet 206 that can be connected to air flow duct 190. Inlet 206 has an one-way check valve 204 and an air filter 202 connected by means of a pipe, or disposed and attached to the inside periphery of inlet 206. Air receiver tank 300 on its opposite side has compressible fluid outlet 280 and to control the flow of compressible fluid 140 there is air flow valve 281 and one-way check valve 282. Air flow duct 190 can be connected to compressible fluid outlet 280. Compressible fluid outlet 280 could be extended in length and could function like air flow duct 190 and all its working members as illustrated on FIG. 8. Using compressed air 130, steam, or supercritical water electricity can be produced locally or downstream. Compressed air 130 can be stored downstream in a cave or vessel and used directly at an electrical power plant. Air receiver tank 300 has an inner wall 210 and an outer wall 208 defining a cylinder 220. Air receiver tank 300 on its upper outer wall 208 is disposed mount 214, on each opposite side that is connected to air receiver tank 300, that is connected to hoist assembly 260, that is connected to electromagnet assembly 240. Inside receiver 300 could be a fluid compression chamber 212. A programmable logic controller (PLC) as defined and discussed herein could be a preferred means for automation of electromechanical processes, such as controlling, operating and actuating air receiver tank 300 and all its elements on run time. The system or air compressor 200 as discussed herein provides a source of motive power for air receiver tank 300 and all its embodiments and elements. Air receiver tank 300 offers additional storage capacity made to compensate for surges in compressed air 130 usage. Air receiver tank 300 could eliminate pulsations from the discharge line. Air receiver tank 300 could be wet or dry. Air receivers could be tanks, vessels or bladders used for compressed air 130 storage air receiver tank 300 is but one type of air receiver that would obviously be in the spirit of the invention. An air receiver tank 300 could be vertical or horizontal depending on the need of the application. Using air receivers of unsound or questionable construction can be very dangerous. Therefore, the American Society of Mechanical Engineers (ASME) has developed a code regarding the construction of pressure vessels, which has been incorporated into many federal, state, and local laws. This particular code is ASME Code Section VIII Division 1. Air receivers should always meet or exceed this code in addition to any other state, municipal, or insurance codes that may apply and should be constructed and operated by someone skilled in the art. Compressed air 130, commonly called Industry's Fourth Utility, is air that is condensed and contained at a pressure that is greater than the atmosphere. The process takes a given mass of air, which occupies a given volume of space, and reduces (squeezes) it into a smaller space. In that space, greater air mass produces greater pressure. The pressure comes from this air trying to return to its original volume. It is used in many different manufacturing operations. A typical compressed air system operating at 100 psig (7 bar) will compress the air down to ⅛ of its original volume. A common height could be, but is not limited to, 125 to 150 feet for residential usage. All or part could be at least one above ground, below ground, and below water. Compressed air 130 can be recycled and piped from air receiver tank 300, or an air flow duct 190 back into air compressor 200 thus acting like a recompressor and would be in the spirit of the invention.

Figure 14:
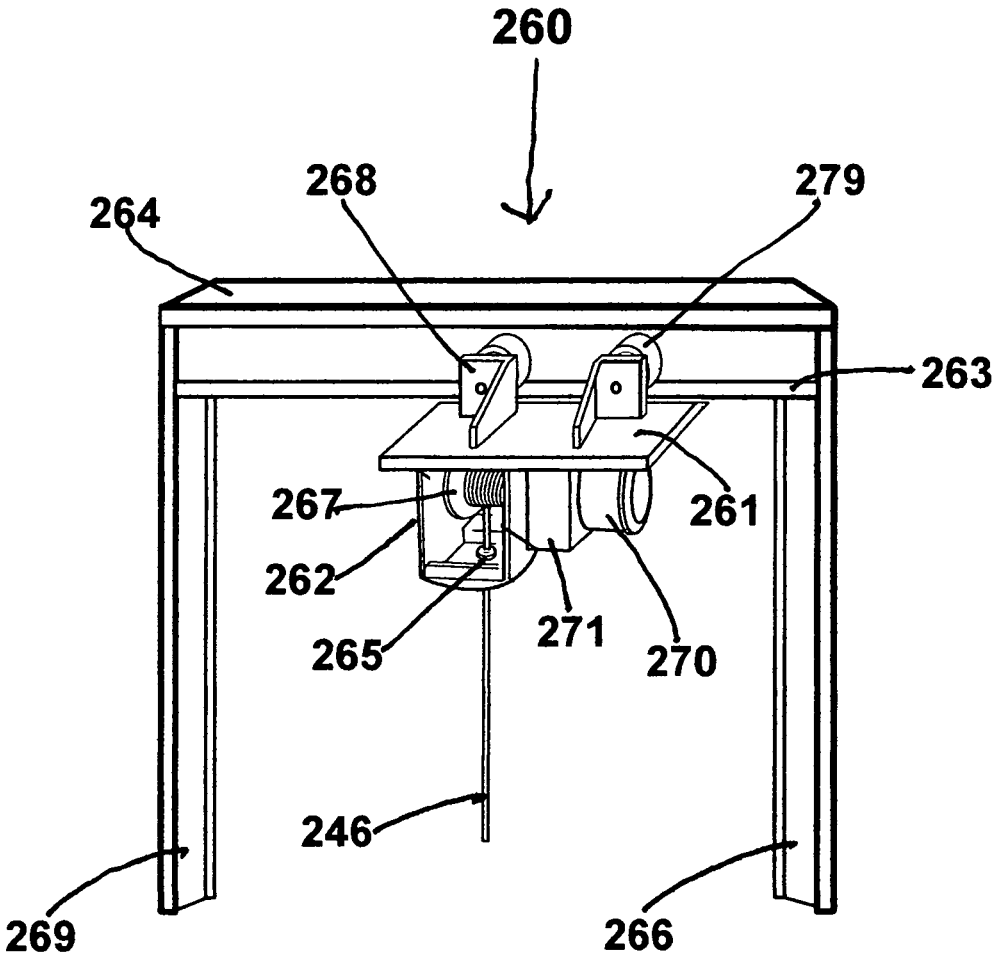
FIG. 14 shows a view of a transporter.
Figure 15:
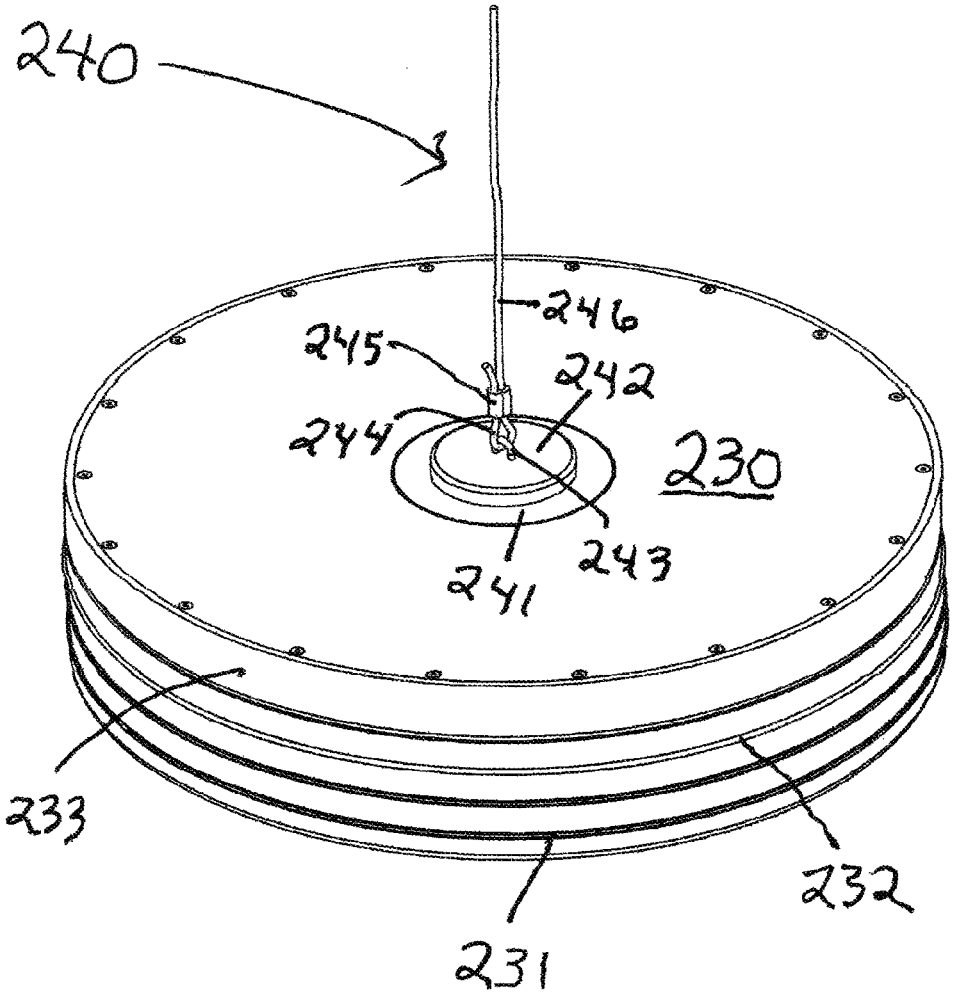
FIG. 15 shows an angled side view of an electromagnet assembly attached to a floating piston.

As seen on FIG. 14 is hoist assembly 260 that is a Gantry crane or overhead crane which comprises of electromagnet assembly 240 as seen on FIG. 15 connected to a wire rope 246, passing through a grommet 265, attached to a drum 267. Air compressor 200 provides a source of power for hoist assembly 260. Hoist assembly 260 comprises a hoist 262 on a trolley 261 on a rollers 279 or cam followers that runs horizontally along a rails 263, fitted on a single rigid overhead I-beam such as a horizontal frame member 264. It is supported by and connected to a right and left vertical beam member 269 and 261 respectively fastened to and resting on the top of mount 214 on each opposite sides, that is connected to air receiver tank 300. Hoist 262 is a device with a source of motive power and is operated by an electric or pneumatic motor 270 and transmission 271 providing controlled application of force configured for lifting or lowering a load by means of drum 267 around which wire rope 246 connects to and wraps around. It could be configured to be electrically, manually, or pneumatically driven and could use chain, fiber or wire rope 246 as its lifting medium. Wire rope 246 could be preferred.

Referring now to another aspect of FIG. 15 that is electromagnet assembly 240, another embodiment of air receiver tank 300. The purpose of electromagnet assembly 240 is to keep floating piston 230 at equilibrium with compressed air 130 in air receiver tank 300. Electromagnet assembly 240 comprises electromagnet 242, wire rope 246, a loop 244, a swage sleeve clamp 245, an ubolt 243. Wire rope 246 is configured to be fastened and wound onto to drum 267 at one end and looped through ubolt 243 and configured to be connected by swage sleeve clamp 245 securely. Ubolt 243 is fastened to the electromagnet top surface or implanted in electromagnet 242 center area itself securely.

Electromagnet 242 does not have to be a magnet in fact it could be a platform smaller than the larger floating piston 230 that could be permanently attached to floating piston 230. Some advantages of electromagnet 242 is that the magnetic field can be rapidly manipulated by controlling the amount of electric current and it is reliable and clean. The electricity can be produced on-site and also be a source of motive power to operate a hoist assembly 260 which operates and causes to function electromagnet 242. Cylinder 220 is larger in diameter than the smaller floating piston 230 which is capable of fluid isolation. Electromagnet 242 could release floating piston 230 inside cylinder 220 after finding equilibrium with floating piston 230 and compressed air 130 or compressible fluid 140, as herein defined, and allow floating piston 230 to slide up and down the inside of cylinder 220 freely with little friction. Cylinder 220 and floating piston 230 are capable of fluid isolation from each other. fluid compression chamber 212 is capable of fluid isolation at base state. Electromagnet 242 is configured to be powered on and off by the current being applied and not applied respectively. For safety electromagnet 242 is configured to pick up several times the weight of floating piston 230. A coating such as plastic could be put around the outside of wire rope 246. A Programmable logic controller (PLC) as described and defined herein could be configured and programmed to operate hoist assembly 260, and electromagnet assembly 240.

Figure 16:
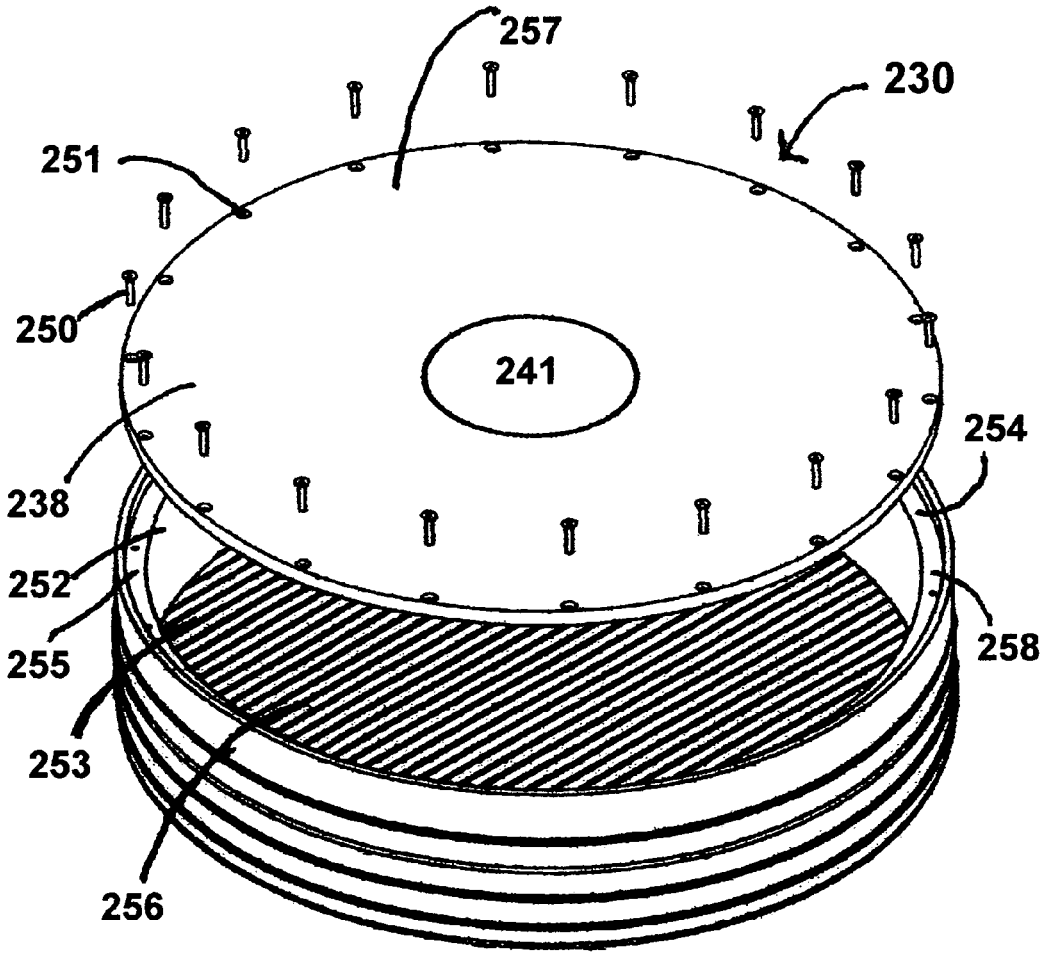
FIG. 16 shows an overhead angled view of a floating piston with the lid open exposing a storage area.

Referring now to another aspect of FIG. 5 an embodiment of floating piston 230 viewed on FIG. 16. Floating piston 230 is a working member configured to be movable up and down cylinder 220 while maintaining fluid compression chamber 212 with slideability. Floating piston 230 has an appropriate sealing system which is capable of fluid isolation. Floating piston 230 could be solid or have storage cavity 253 defining a storage area or container in which gravel and water or other matter could be disposed to permit appropriate weight adjustment. Floating piston 230 is free floating inside air receiver tank 300 and is urged up and downward by the force of gravity. The outside periphery of floating piston 230 is capable of fluid isolation do to the pressure applied onto inner walls 210 of air receiver tank 300 by the outer periphery of floating piston 230. Extending vertically from bottom 256 periphery fastened or molded is a cylindrical shaped inner wall 252 defining a cylindrical container or hollow cavity which defines floating piston 230. Inner wall 252 has a recessed inside rim 255 that supports rim holes 254 that is in vertical alignment with lid 257, lid holes 251, and connector 250 that are along several intermediate stations around the center circumference of inside rim 255. Inside rim 255 has an smaller circumference and disposed lid 257 is configured so all holes and connectors 250 are in alignment, fit securely, and is capable of fluid isolation. A resilient member, such as a gasket 258 or o-ring, could be disposed onto inside rim 255 that lid 257 sets on, that further guarantees a watertight seal when lid 257 is closed. A metal disc 241 is flush with lid surface 238 and embedded firmly in lid 257.

Figure 18:
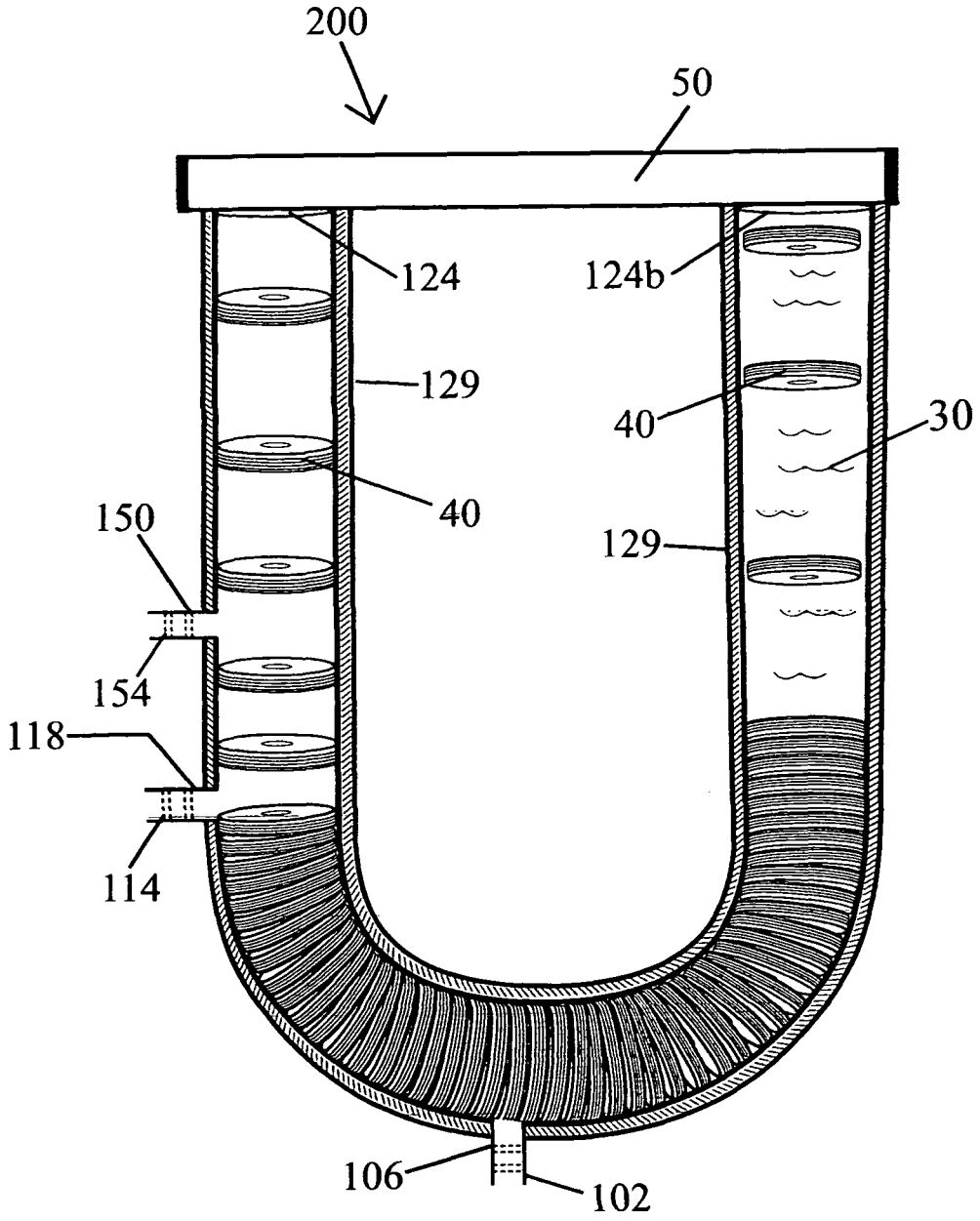
FIG. 18 shows a view of an air compressor.

Referring now to another aspect of an embodiment of air compressor 200 as illustrated on FIG. 18. The purpose in this particular embodiment is to compress air and provide recovery for piston 40. Air compressor 200 has at least one or more of the following condensation nozzle 106, air flow outlet 118, piston exit outlet 105, and gauge and valve outlet 150 for valves, gauges, and other measuring and monitoring devices. Gauge and valve outlet 150 can have one-way check valve 154 to control the flow of the fluid. Liquid filter 102 and one-way check valve 104 are fastened to or inside the periphery of nozzle 106 that is located at the lowest point of wall 121 configured to purge water and sediment. Cylinder 129 could be configured like a hook (J) or a (U) with a slow bending curve. The force downward of the contents in the compression side of cylinder 129 could be offset by the force on the piston exit side of cylinder 129 or the piston 40 could be held in place by pusher 180 until it is time to be released into liquid 30 or to transporter 50. Cylinder 129 can be larger than piston 40 on the top portion of cylinder 129 exit side such as an opening 124*b*. Opening 124*b* can be a piston exit. Cylinder 129 could be configured in part or all, on the exit side, as that of piston transfer outlet 79. Piston transporter assembly 50 enables piston 40 to be transferred from opening 124*b* to opening 124 and deposited into cylinder 129. Cycle three could be where fluid starts to flow into air flow outlet 118 that provides a whole in wall 121 of cylinder 129. When the flow controlled by an one-way check valve 116 and a flow control valve 114 has substantially emptied out plenum chamber 137 or compression chamber 132 the cycle has ended Pusher assembly 180 can be configured to hold piston 40 in place to give stability to piston 40 while the plenum chamber 137 above is discharging its plenum 140 through air flow outlet 118 and into air flow duct 190. Possibly any configuration obvious to someone skilled in the art that would allow one end fed by the transfer device to have a greater downward force of gravity at least the weight of one piston 40 and it must have piston 40 totally free from being impeded in any way to move up and down by the force of gravity on the compression side. One example would be that of a water level the fluid must be unimpeded totally to seek level. This would work like a water level taking advantage of the basic physics fact water always seeks its own level. Piston 40 and the contents in cylinder 129 could be configured to be capable to function like a water level. It could have the end fed by the transfer device have a substantially greater downward force of gravity and must have piston 40 totally free from being impeded in any way to move up and down by the force of gravity on the outlet side. If this is accomplished piston 40 can be deposited in a liquid 30 to cycle to the top of cylinder 129 and be deposited into cylinder 129 starting a complete cycle all over again. Pusher 172 could be attached to a platform at its distal end and be configured to press against wall 121 where the wall can be semi flexible to allow pusher 172 to be configured to hold one or more piston 40 in place until it is time to release them at a predetermined time. Transporter assembly can the be configured to grab piston 40 from opening 124*b* that is larger in diameter than piston 40 and take it to opening 124 as discussed in at least one cycle 1, 5, 6, and 7 above herein. FIG. 18 another embodiment of compressor 200 can have all of the valves, outlets, nozzles, and elements and functionality air compressor 200 has and has been discussed in detail in FIG. 2, FIG. 3 and FIG. 17 air compressor 200 out of water. This particular embodiment of air compressor 200 can be a heat source and be wrapped in tubing as discussed in FIG. 2, FIG. 3 and FIG. 17.

It would be obvious to someone skilled in the art wind turbines creating energy could enjoy large volumes of air flow (wind) created by multiple properly timed and configured air compressor 200 that could create large volumes of hurricane force winds in air flow duct 190 configured as a wind tunnel. The size of air flow duct 190 varies greatly from approximately 1 inch or less in diameter to 4 feet in diameter and because it can take the form of a wind tunnel, it could be 4 feet to 20 or more feet in diameter. Air flow duct 190 could be horizontal or vertical. A plurality of air compressor 200 could be feeding into one or more air flow duct 190 contributing volumes of compressible fluid 140. It would also be obvious to someone skilled in the art any or all embodiments could be in a hermetic casing or housing. Wind or compressed air 130 could be produced by air compressor 200 that could be turned into mechanical energy. Moving fluid acts on the blades of a turbine so that they move and impart rotational energy to the rotor assembly. The mechanical energy could be used to drive machinery, such as for grinding grain or pumping water. The mechanical energy could be used to produce electricity. Cylinder 129 could have at least one of a reciprocating compressor, rotary screw compressor, and turbo compressor attached to the base or side of cylinder 129 with fluid communication causing air flow through an opening for the function of recompressing the already compressed air 130 into a higher PSI or a smaller mass causing a temperature rise or a greater heat source. Compressible fluid exit 118 with a flow valve to control the flow would serve as an outlet for compressed air 130 to be used locally or downstream.

Air compressor 200, air flow duct 190, and piston transfer duct 80 could be not only vertically upright, but they could also slope at an angle from 30 degrees to 160 degrees. Another aspect of this system could be used to provide electricity to areas there is no electricity at present the time such as undeveloped land, on or below the ocean or a lake where there are no power lines.

Another configuration of an embodiment is an elongated cylindrical tube in the form of a U shape that could serve as an air compressor 200 each side providing force to equalize the force at the base portion of the U shape. Air compressor 200 on one side of the U shape and a piston transporter on the opposite side of the U shape. One side of the U shape tube configured to compress air the other side of the U shape configured to enable the piston to be transported back into air compressor 200 to start a cycle over again. This configuration along with air flow ducts with valves to control the air flow, transfer tank 100, piston transfer ducts 80 and air receiver tank 300 together as working members could provide compressed air, steam and a source of heat. Manufacturing plants and factories could use compressed air 130 for energy, moving mechanical devices, machines, heating and cooling products, warming and cooling buildings such as working environments and many other uses that are known to someone skilled in the art. With the present apparatus, energy can be produced reliably from compressed air 130 or steam environmentally, economically, consistently, and on-site. Water (condensation), possibly thousands of gallons a year, could be another rainfall-independent water source advantage enjoyed. The object of the present apparatus and system is to provide a multi-functional air compressing apparatus capable of providing a source of heat, a source of cooling, compressed air, steam, hot and cold air, pump, blower, cooker, boiler, cannon, compressor, recompressor, a superheater, and a heater. Compressed air-operated drills, paint sprayers, screwdrivers, and wrenches, vacuum operations, manufacturing operations, production line operations, grinding, sanding, motors, plant operations for making ships, cars, aircraft, locomotives, vacuums, cleaning are but a few of the uses for air compressor 200 and all its elements and embodiments. A ship could pull air compressor 200 on a raft and be provided motive power through electricity, steam, or compressed air 130 to enable a ship to be operated without the need for stopping for fuel and possibly water. A locomotive could pull air compressor 200 and used for motive power. An aircraft could pull air compressor 200 and may not need to land for fuel. Air compressor 200 could be configured to completely eliminate power outages from bad weather and the cost of trying to get the power re-established. Air compressor 200 could eliminate long power lines with on-site power. Taking advantage of air compressor 200 as a heat source could eliminate the need for train loads of coal or hauling train loads of fly ash off. In a thermal power station in which the heat source is a nuclear reactor causing radioactive wastes the waste could be eliminated taking advantage of air compressor 200 as a heat source. With wind turbines large amounts of land must be leased or purchased, using air compressor 200 as a blower in a wind tunnel could eliminate that expense. Hydro-power uses large amounts of land, future plants could replace water with steam or compressed air using air compressor 200. Desert land, a heat source in Arctic land, and underwater housing could enjoy the many advantages discussed. The foregoing has been a detailed description of various embodiments of the invention. Various modifications and additions can be made without departing from the spirit and scope of the invention. Each of the various embodiments and elements described above could be combined with other described embodiments and elements in order to provide multiple features. One example could be three or more air compressors 200 in a deep water application encircled so as to keep piston 40 in a central location as it floats to the surface. This would eliminate the need of transfer tank 100. Furthermore, while the foregoing describes a number of separate embodiments of the apparatus and method of the present invention, what has been described herein is merely illustrative of the application of the principles of the present invention. For example, the size, performance characteristics and number of components used to implement the system or embodiments is highly variable. Accordingly, the described embodiments are to be considered in all respects as only illustrative and not restrictive.

I claim:

1. An air compressor apparatus for compressing a first compressible fluid, comprising:

a plurality of pistons;

a cylinder having an opening located in a predetermined location configured to allow the plurality of pistons and the first compressible fluid to enter the cylinder, wherein the cylinder further has a piston exit and a compressible fluid exit which are both located below the opening and which respectively allow the pistons and the compressible fluid to be discharged from the cylinder, wherein the pistons, when disposed in the cylinder, form a substantially fluid tight seal with an inner wall of the cylinder and define compression chambers between adjacent pistons, the compression chambers traveling downward through the cylinder as the pistons are moved downward by the force of gravity;

a transporter configured to transport the pistons from the piston exit to the opening and to place said pistons into the cylinder via the opening at predetermined intervals; and a tubing coiled around an outer wall of the cylinder.

2. The air compressor apparatus of claim 1, wherein the cylinder has a slope of between approximately 30 and 160 degrees.

3. The air compressor apparatus of claim 1, wherein the transporter includes a second cylinder in which the pistons are moved upward by buoyancy.

4. The air compressor apparatus of claim 1, further comprising connectors configured to attach said tubing to said outer wall.

5. The air compressor apparatus of claim 1, wherein the pistons are substantially disc-shaped.

6. The air compressor apparatus of claim 1, wherein the pistons are hollow.

7. The air compressor apparatus of claim 1, wherein the tubing has an entrance and an exit for a second fluid.

8. The air compressor apparatus of claim 7, wherein the second fluid absorbs heat from the outer wall.

* * * * *